US011086245B2

(12) United States Patent
Yamashita et al.

(10) Patent No.: US 11,086,245 B2
(45) Date of Patent: Aug. 10, 2021

(54) IMAGE FORMING APPARATUS, PROCESS CARTRIDGE, AND CARTRIDGE SET

(71) Applicant: CANON KABUSHIKI KAISHA, Tokyo (JP)

(72) Inventors: Mariko Yamashita, Shizuoka (JP); Tetsuya Kinumatsu, Shizuoka (JP); Daisuke Yoshiba, Shizuoka (JP); Michiyo Sekiya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/129,468

(22) Filed: Dec. 21, 2020

(65) Prior Publication Data

US 2021/0200111 A1 Jul. 1, 2021

(30) Foreign Application Priority Data

Dec. 26, 2019 (JP) ..... JP2019-237011

(51) Int. Cl.

| | |
|---|---|
| ***G03G 15/08*** | (2006.01) |
| ***G03G 9/097*** | (2006.01) |
| ***G03G 9/087*** | (2006.01) |
| ***G03G 21/18*** | (2006.01) |
| ***G03G 9/08*** | (2006.01) |

(52) U.S. Cl.

CPC ..... *G03G 9/09733* (2013.01); *G03G 9/0821* (2013.01); *G03G 9/08757* (2013.01); *G03G 15/0808* (2013.01); *G03G 21/1814* (2013.01)

(58) Field of Classification Search

CPC .. G03G 9/0821; G03G 9/087; G03G 9/08757; G03G 9/09733; G03G 15/0808; G03G 21/1814

See application file for complete search history.

(56) References Cited

U.S. PATENT DOCUMENTS

| | | | | |
|---|---|---|---|---|
| 8,053,151 | B2 * | 11/2011 | Wu | G03G 5/0696 430/59.1 |
| 2012/0052429 | A1 | 3/2012 | Wosnick et al. | |
| 2014/0369715 | A1 * | 12/2014 | Zhang | G03G 5/0564 399/159 |
| 2017/0090310 | A1 | 3/2017 | Katsuhara et al. | |
| 2018/0004146 | A1 | 1/2018 | Ota et al. | |

FOREIGN PATENT DOCUMENTS

| | | | |
|---|---|---|---|
| JP | 2015-127818 | A | 7/2015 |
| WO | 2013047296 | A1 | 4/2013 |

* cited by examiner

*Primary Examiner* — Hoang X Ngo

(74) *Attorney, Agent, or Firm* — Canon U.S.A., Inc., IP Division

(57) ABSTRACT

An image forming apparatus comprising an electrophotographic photosensitive member and a developing device that has a toner and supplies the toner onto the electrophotographic photosensitive member, wherein the electrophotographic photosensitive member comprises a surface layer comprising a binder resin (A), the binder resin (A) comprises a specific structure, the toner comprises a toner particle, the toner particle comprises a binder resin (B) and a wax, and the wax comprises a prescribed diester compound; and a process cartridge and a cartridge set.

10 Claims, 1 Drawing Sheet

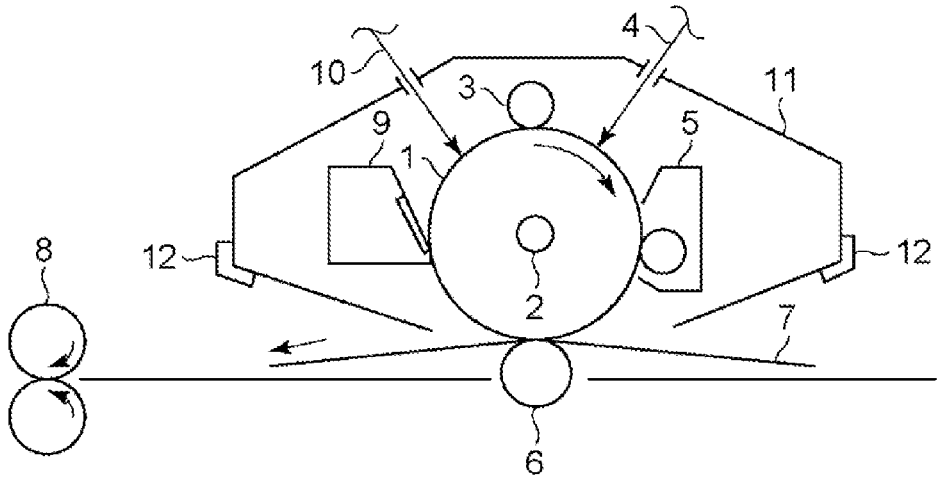
10
4
3
11
9
5
1
8
12
12
2
7
6

IMAGE FORMING APPARATUS, PROCESS CARTRIDGE, AND CARTRIDGE SET

BACKGROUND OF THE INVENTION

Field of the Invention

The present disclosure relates to an image forming apparatus, a process cartridge, and a cartridge set.

Description of the Related Art

In a known electrophotographic method, an image is obtained through, e.g., a charging step of charging an image bearing member by using a charging member, an electrostatic latent image forming step of forming an electrostatic latent image on the image bearing member, a developing step of forming a toner image by developing the electrostatic latent image by using a toner, and a transfer step of transferring the toner image to a recording paper. Copiers and printers are examples of image forming apparatuses (also called electrophotographic apparatuses) that employ such an electrophotographic method.

Higher speeds and greater energy savings are required of these printers and copiers, and in order to meet the requirements, there is a demand for further improvement in terms of various capabilities thereof. With regard to the toner in particular, from the standpoint of boosting the speed and energy savings, improvements in the low-temperature fixability, that is, rapid melting at lower temperatures, are required.

While various means exist in order to achieve low-temperature fixability, there have been various investigations into the use of an ester wax, which can impart plasticity to the binder resin, in a toner with the aim of improving the low-temperature fixability of the toner. The mechanism underlying these investigations is that an ester wax, which melts and liquefies upon the application of heat, plasticizes a binder resin, resulting in a drop in viscosity when the toner melts and enabling a toner having an excellent low-temperature fixability to be obtained.

In addition to the requirements for low-temperature fixability, there has in recent years also been strong demand from the market for further enhancement in image quality and product quality. In response to these demands, for example, WO 2013/047296 proposes a toner of which low-temperature fixability is improved through the use of a diester compound.

SUMMARY OF THE INVENTION

However, with the toner according to WO 2013/047296, it was found that the compatibility between the diester compound and binder resin is excellent and the diester compound readily occurs in the vicinity of the toner surface. It was also found that as a result the properties and structure of the diester compound in the toner readily exercise a major influence on an adhesive force with regard to members that come into contact with the toner.

Specifically, it was found that toner containing the diester compound readily exhibits a low adhesive force with regard to the electrophotographic photosensitive member (also referred to herebelow simply as a "photosensitive member") and that the occurrence of so-called "scattering", i.e., scattering of a toner on an electrostatic latent image onto recording paper prior to the transfer step, is facilitated, making it difficult to obtain a high definition image.

The present disclosure provides an image forming apparatus, process cartridge, and cartridge set, each of which can suppress toner scattering while improving low-temperature fixability.

The present inventors have discovered that the aforementioned problem is solved by using in a toner a wax having a prescribed structure and by using, in a surface layer the photosensitive member, a binder resin having a prescribed structure.

That is, an image forming apparatus of the present disclosure is an image forming apparatus comprising:

an electrophotographic photosensitive member; and a developing device that has a toner and supplies the toner onto the electrophotographic photosensitive member, wherein the electrophotographic photosensitive member comprises a surface layer comprising a binder resin (A), the binder resin (A) comprises a structure represented by formula (1) below:

(1)

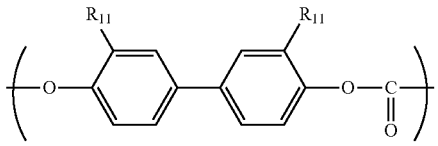

where, each $R_{11}$ independently represents a hydrogen atom or a methyl group, the toner comprises a toner particle, the toner particle comprises a binder resin (B) and a wax, and the wax comprises a diester compound represented by formula (2) below:

(2)

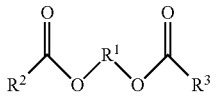

where, $R^1$ represents an alkylene group having 1 to 3 carbons and $R^2$ and $R^3$ each independently represent an alkyl group having 11 to 25 carbons.

In addition, a process cartridge of the present disclosure is a process cartridge disposed detachably in a main body of an image forming apparatus, wherein the process cartridge comprises an electrophotographic photosensitive member, and a developing device that has a toner and supplies the toner onto the electrophotographic photosensitive member, the electrophotographic photosensitive member comprises a surface layer comprising a binder resin (A), the binder resin (A) comprises a structure represented by formula (1) below:

(1)

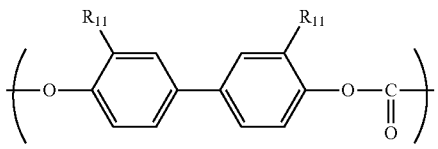

where, each $R_{11}$ independently represents a hydrogen atom or a methyl group, the toner comprises a toner particle, the toner particle comprises a binder resin (B) and a wax, and the wax comprises a diester compound represented by formula (2) below:

(2)

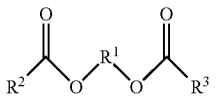

where, $R^1$ represents an alkylene group having 1 to 3 carbons and $R^2$ and $R^3$ each independently represent an alkyl group having 11 to 25 carbons.

Further, a cartridge set of the present disclosure is a cartridge set comprising a first cartridge and a second cartridge that are disposed detachably in a main body of an image forming apparatus, wherein the first cartridge has an electrophotographic photosensitive member, the second cartridge has a toner container that accommodates a toner for forming a toner image on a surface of the electrophotographic photosensitive member by developing an electrostatic latent image formed on the surface of the electrophotographic photosensitive member, the electrophotographic photosensitive member comprises a surface layer comprising a binder resin (A), the binder resin (A) comprises a structure represented by formula (1) below:

(1)

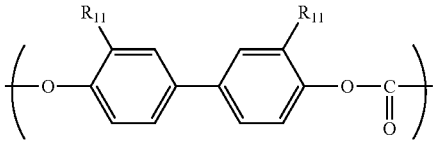

where, each $R_{11}$ independently represents a hydrogen atom or a methyl group, the toner comprises a toner particle, the toner particle comprises a binder resin (B) and a wax, and the wax comprises a diester compound represented by formula (2) below:

(2)

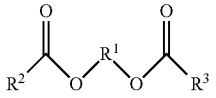

where, $R^1$ represents an alkylene group having 1 to 3 carbons and $R^2$ and $R^3$ each independently represent an alkyl group having 11 to 25 carbons.

According to the present disclosure, an image forming apparatus, process cartridge, and cartridge set, each of which can suppress toner scattering while improving low-temperature fixability, can be provided.

Further features of the present invention will become apparent from the following description of exemplary embodiments with reference to the attached drawings.

BRIEF DESCRIPTION OF THE DRAWINGS

The FIGURE is an example of an image forming apparatus.

DESCRIPTION OF THE EMBODIMENTS

Unless specifically indicated otherwise, the expressions "from XX to YY" and "XX to YY" that show numerical value ranges refer in the present disclosure to numerical value ranges that include the lower limit and upper limit that are the end points.

The present inventors conducted intensive investigations into an image forming apparatus in which the low-temperature fixability would co-exist in good balance with a suppression of toner scattering.

It was found as a result that the phenomenon of toner scattering, which is a focus of the present disclosure, is produced mainly by the mechanism described in the following.

The process for achieving image formation is described first.

The generation of an image utilizing an electrophotographic method proceeds, for example, through, inter alia, a charging step of charging an image bearing member using a charging member, an electrostatic latent image forming step of forming an electrostatic latent image on the image bearing member, a developing step of forming a toner image by developing this electrostatic latent image using a toner, a transfer step of transferring this toner image to a recording paper, and a fixing step in which the toner image is heated and melted and fixed to the recording paper.

It was found that, among these steps, toner scattering readily occurs caused by transfer of the toner to the recording paper prior to the transfer step. That is, toner scattering readily occurs when the adhesive force between the toner and photosensitive member is weak. It is thus crucial for raising the image quality to enhance the adhesive force between the toner surface and the surface layer of the photosensitive member; however, it was also found that an overly strong adhesive force ends up reducing the transfer efficiency in the transfer step.

The present inventors focused on the relationship between the wax, which exercises a major influence on the adhesive force of toner, and the binder resin (A) present in the surface layer of the photosensitive member. They discovered that—through the use of toner that utilizes wax having a prescribed structure and the use of a photosensitive member having in its surface layer the binder resin (A) having a prescribed structure—the adhesive force between the toner and photosensitive member could be favorably controlled and the low-temperature fixability could be made to co-exist with a suppression of toner scattering.

The "surface layer" here is the layer located on the surfacemost side of the photosensitive member and is the surface where the outer surface of the surface layer contacts the toner.

That is, an image forming apparatus of the present disclosure is an image forming apparatus comprising:

an electrophotographic photosensitive member; and a developing device that has a toner and supplies the toner onto the electrophotographic photosensitive member, wherein the electrophotographic photosensitive member comprises a surface layer comprising a binder resin (A), the binder resin (A) comprises a structure represented by formula (1) below:

(1)

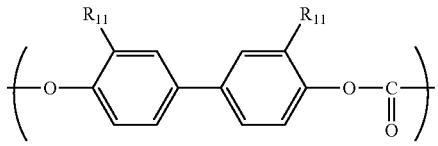

where, each $R_{11}$ independently represents a hydrogen atom or a methyl group, the toner comprises a toner particle, the toner particle comprises a binder resin (B) and a wax, and the wax comprises a diester compound represented by formula (2) below:

(2)

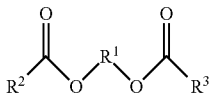

where, $R^1$ represents an alkylene group having 1 to 3 carbons and $R^2$ and $R^3$ each independently represent an alkyl group having 11 to 25 carbons.

The toner comprises a toner particle. This toner particle comprises a binder resin (B) and a wax. This wax comprises a diester compound represented by formula (2) below (this is also referred to herebelow simply as the "diester compound").

(2)

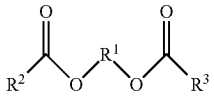

In formula (2), $R^1$ represents an alkylene group having from 1 to 3 carbons and $R^2$ and $R^3$ each independently represent an alkyl group having from 11 to 25 carbons.

This diester compound has a high ester group concentration and a high mobility. As a consequence, a wax containing this diester compound readily undergoes melting and liquefaction in the toner upon the application of heat. This liquefied wax plasticizes the binder resin (B), described below, and as a result the viscosity declines when the toner is melted and a toner having an excellent low-temperature fixability can be obtained.

Moreover, this diester compound is suitably compatible with the binder resin (B), described below, and due to this the state of occurrence of the wax in the toner is easily controlled and the effects of the present disclosure are readily obtained. Coexistence between the low-temperature fixability and toner storage stability is also readily brought about because the diester compound has a suitable compatibility with the binder resin (B).

However, this diester compound readily exhibits a good compatibility with the binder resin (B) and readily occurs in the vicinity of the toner surface. This facilitates the occurrence of a low adhesive force between the surface layer of the photosensitive member and toner containing wax that contains this diester compound.

That is, the present inventors regard the low adhesive force with the photosensitive member as having an influence on the toner scattering that is a focus of the present disclosure.

In order to control the adherence between the toner and photosensitive member, the present inventors therefore carried out intensive investigations focusing on the molecular structure of the binder resin that is present in the toner-contacting surface layer of the photosensitive member.

The photosensitive member comprises a surface layer that comprises the binder resin (A), and this binder resin (A) comprises a structure represented by formula (1) below.

(1)

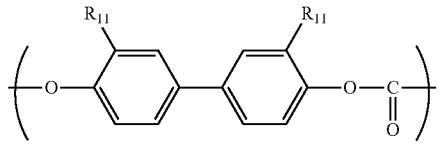

The $R_{11}$'s in formula (1) independently represent a hydrogen atom or methyl group.

The content in the binder resin (A) of the structure with formula (1) is not particularly limited, but is preferably at least 10 mass %. This content is preferably not more than 100 mass %. Any combination of these numerical value ranges may be used.

The proportion of this structure with formula (1) is also not particularly limited, but, based on the total number of moles of all the monomer units in the binder resin (A), is preferably at least 10 mol % and more preferably at least 25 mol %. This proportion is preferably not more than 100 mol %, more preferably not more than 80 mol %, still more preferably not more than 70 mol %, and particularly preferably not more than 50 mol %. Any combination of these numerical value ranges may be used.

Through the incorporation in the surface layer of the photosensitive member of the binder resin (A) comprising the structure represented by formula (1), the electrical characteristics can be maintained while rubbing-induced wear of the photosensitive member is restrained and the durability is improved.

Toner scattering occurs when the binder resin (A) does not comprise the structure represented by formula (1).

The weight-average molecular weight (Mw) of the binder resin (A) is preferably in the range from 10,000 to 300,000 and is more preferably in the range from 20,000 to 200,000. This Mw can be controlled through the polymerization conditions, e.g., the monomer blending ratios, the reaction temperature, and so forth.

The binder resin (A) preferably comprises the structure represented by formula (3) below.

(3)

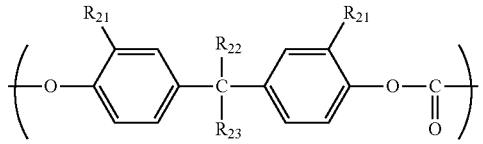

The $R_{21}$'s in formula (3) independently represent a hydrogen atom or methyl group. $R_{22}$ and $R_{23}$ each independently represent a hydrogen atom, methyl group, ethyl group, or phenyl group, or $R_{22}$, $R_{23}$, and the C between $R_{22}$ and $R_{23}$ in formula (3) are connected to form a cycloalkylidene group.

$R_{22}$ and $R_{23}$ are preferably connected with the C between $R_{22}$ and $R_{23}$ to form a cycloalkylidene group. The number of carbons in this cycloalkylidene group is not particularly limited, but is preferably from 4 to 12 and more preferably is from 5 to 8. The structure represented by formula (3) particularly preferably has the structure represented by formula (3") below.

(3")

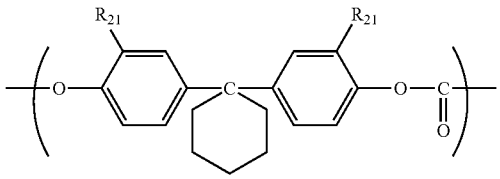

The $R_{21}$'s in this formula independently represent a hydrogen atom or methyl group.

For the case in which $R_{22}$, $R_{23}$, and the C between $R_{22}$ and $R_{23}$ represented by formula (3) are not connected to form a cycloalkylidene group, $R_{22}$ is then preferably a methyl group and $R_{23}$ is preferably an ethyl group.

When the binder resin (A) comprises the structure represented by formula (3), the electrical characteristics are improved, which is linked to an enhanced image quality.

Considered from the standpoints of the durability and electrical characteristics, the molar ratio (structure represented by formula (1):structure represented by formula (3)), in the binder resin (A), between the structure represented by formula (1) and the structure represented by formula (3), is preferably 5:95 to 95:5.

The lower limit for this molar ratio is more preferably at least 10:90, at least 15:85, at least 20:80, at least 25:75, at least 30:70, at least 35:65, at least 40:60, or at least 45:55.

The upper limit for this molar ratio is more preferably not more than 90:10, not more than 85:15, not more than 80:20, not more than 75:25, not more than 70:30, not more than 65:35, not more than 60:40, not more than 55:45, or not more than 50:50.

Any combination of these numerical value ranges may be used.

The method for producing the binder resin (A) should be able to produce resin having the structure with formula (1) (and optionally the structure represented by formula (3)), but is not otherwise particularly limited. This production method can be exemplified by the following methods: the execution of interfacial condensation polymerization on phosgene and a diol compound for providing the structure represented by formula (1) and optionally a diol compound for providing the structure represented by formula (3); the execution of a transesterification reaction between said diol compound and diphenyl carbonate.

A more specific example is a method in which interfacial condensation polymerization is run with phosgene and a diol compound represented by formula (1') below (and optionally a diol compound represented by formula (3')) below.

(1')

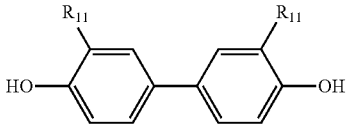

-continued (3')

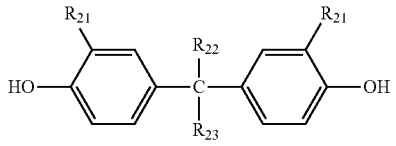

The $R_{11}$'s in formula (1') independently represent a hydrogen atom or methyl group.

The $R_{21}$'s in formula (3') independently represent a hydrogen atom or methyl group. $R_{22}$ and $R_{23}$ each independently represent a hydrogen atom, methyl group, ethyl group, or phenyl group, or $R_{22}$, $R_{23}$, and the C between $R_{22}$ and $R_{23}$ in formula (3') are connected to form a cycloalkylidene group.

The structure with formula (1) present in the binder resin (A) in the surface layer of the photosensitive member has a molecular size near that of the diester compound present in the wax in the toner and also exhibits a high affinity with same in terms of molecular structure. Due to this, the adhesive force between the toner and photosensitive member is increased due to the presence of the structure with formula (1) in the surface layer of the photosensitive member and the presence of the diester compound in the vicinity of the toner surface. This is considered to be due to the following relationships.

Compared to the other hydrogen atoms, a stronger positive polarization is exhibited by the hydrogen atoms bonded to the carbon atoms adjacent to the carbon atom that is ether bonded to the oxygen atom in the structure with formula (1) present in the binder resin (A) in the surface layer of the photosensitive member, and these positive polarization sites are symmetrically present. The double-bonded oxygen atoms in the ester bonds in the diester compound present in the wax in the toner, on the other hand, have a negative polarization, and these negative polarization sites are symmetrically present. Thus, due to the presence of the structure with formula (1) in the surface layer of the photosensitive member and the presence of the diester compound in the vicinity of the toner surface, an electrostatic interaction operates between the surface layer of the photosensitive member and the toner surface and the adhesive force between the photosensitive member and the toner is suitably increased. It is thought that, due to this, the adhesive force does not become excessively high and the transfer efficiency is not reduced, and the occurrence of toner scattering is impeded.

The present disclosure was achieved through detailed analyses of the toner and photosensitive member and through their combinations and could not be readily achieved from the prior art.

The toner used in the present disclosure is further described in the following.

The $R^1$ in formula (2) for the diester compound contained in the toner particle represents an alkylene group having from 1 to 3 carbons. This alkylene group preferably represents an alkylene group having 2 or 3 carbons, and is more preferably the ethylene group (—$CH_2$—$CH_2$—) or trimethylene group (—$CH_2$—$CH_2$—$CH_2$—) and is still more preferably the ethylene group.

The compatibility with the binder resin (B) is reduced when $R^1$ is not a $C_{1-3}$ alkylene group. On the other hand, when $R^1$ is the ethylene group or trimethylene group, and when the $R^1$ having a suitable compatibility with the binder resin (B) is the ethylene group, the planarity of the structure represented by formula (2) is increased and the affinity with the structure represented by formula (1) is further raised, and this is thus more preferred.

The $C_{1-3}$ alkylene group represented by $R^1$ (preferably a $C_{2-3}$ alkylene group) may have a substituent.

In addition, when $R^1$ is a $C_{1-3}$ alkylene group, the molecular size of the diester compound is near to that of the structure represented by formula (1) in the binder resin (A) and the affinity is enhanced.

Specifically, using A1 for the length of the single bond between the phenyl groups in formula (1) and B1 for the length of the $R^1$ in the diester compound, the value of A1-B1 is preferably from 0.00 angstrom to 0.15 angstrom. When the value of A1-B1 is from 0.00 angstrom to 0.15 angstrom, the molecular size of the structure with formula (1) is near to that of the diester compound, and this is preferred from the standpoint of the affinity between the structure with formula (1) and the diester compound. The value of A1-B1 is more preferably from 0.00 angstrom to 0.10 angstrom.

The $R^2$ and $R^3$ in formula (2) each independently represent an alkyl group having from 11 to 25 carbons. $R^2$ and $R^3$ may thus be the same group or may be different groups. Viewed from the standpoint of the low-temperature fixability of the toner, $R^2$ and $R^3$ are preferably an alkyl group having from 13 to 21 carbons and more preferably are an alkyl group having from 15 to 19 carbons.

The alkyl group having from 11 to 25 (preferably from 13 to 21 and more preferably from 15 to 19) carbons may be a straight-chain alkyl group or a branched alkyl group, but a straight-chain alkyl group is preferred.

The diester compound with formula (2) is specifically exemplified by the following compounds, but is not limited thereto:

ethylene glycol distearate ($R^1$=—$C_2H_4$—, $R^2$=$R^3$=—$C_{17}H_{35}$), trimethylene glycol distearate ($R^1$=—$C_3H_6$—, $R^2$=$R^3$=—$C_{17}H_{35}$), ethylene glycol arachidinate stearate ($R^1$=—$C_2H_4$—, $R^2$=—$C_{19}H_{39}$, $R^3$=—$C_{17}H_{35}$), trimethylene glycol arachidinate stearate ($R^1$=—$C_3H_6$—, $R^2$=—$C_{19}H_{39}$, $R^3$=—$C_{17}H_{35}$), ethylene glycol stearate palmitate ($R^1$=—$C_2H_4$—, $R^2$=—$C_{17}H_{35}$, $R^3$=—$C_{15}H_{31}$), trimethylene glycol stearate palmitate ($R^1$=—$C_3H_6$—, $R^2$=—$C_{17}H_{35}$, $R^3$=—$C_{15}H_{31}$), ethylene glycol dimyristate ($R^1$=—$C_2H_4$—, $R^2$=$R^3$=—$C_{13}H_{27}$), trimethylene glycol dimyristate ($R^1$=—$C_3H_6$—, $R^2$=$R^3$=—$C_{13}H_{27}$), ethylene glycol dipentadecanoate ($R^1$=—$C_2H_4$—, $R^2$=$R^3$=—$C_{14}H_{29}$), trimethylene glycol dipentadecanoate ($R^1$=—$C_3H_6$—, $R^2$=$R^3$=—$C_{14}H_{29}$), ethylene glycol dipalmitate ($R^1$=—$C_2H_4$—, $R^2$=$R^3$=—$C_{15}H_{31}$), trimethylene glycol dipalmitate ($R^1$=—$C_3H_6$—, $R^2$=$R^3$=—$C_{15}H_{31}$), ethylene glycol dimargarate ($R^1$=—$C_2H_4$—, $R^2$=$R^3$=—$C_{16}H_{33}$), trimethylene glycol dimargarate ($R^1$=—$C_3H_6$—, $R^2$=$R^3$=—$C_{16}H_{33}$), ethylene glycol dinonadecanoate ($R^1$=—$C_2H_4$—, $R^2$=$R^3$=—$C_{18}H_{37}$), trimethylene glycol dinonadecanoate ($R^1$=—$C_3H_6$—, $R^2$=$R^3$=—$C_{18}H_{37}$), ethylene glycol diarachidinate ($R^1$=—$C_2H_4$—, $R^2$=$R^3$=—$C_{19}H_{39}$), trimethylene glycol diarachidinate ($R^1$=—$C_3H_6$—, $R^2$=$R^3$=—$C_{19}H_{39}$), ethylene glycol dibehenate ($R^1$=—$C_2H_4$—, $R^2$=$R^3$=—$C_{21}H_{43}$), trimethylene glycol dibehenate ($R^1$=—$C_3H_6$—, $R^2$=$R^3$=—$C_{21}H_{43}$), ethylene glycol dicerotate ($R^1$=—$C_2H_4$—, $R^2$=$R^3$=—$C_{25}H_{51}$), trimethylene glycol dicerotate ($R^1$=—$C_3H_6$—, $R^2$=$R^3$=—$C_{25}H_{51}$), ethylene glycol dilaurate ($R^1$=—$C_2H_4$—, $R^2$=$R^3$=—$C_{11}H_{23}$), and trimethylene glycol dilaurate ($R^1$=—$C_3H_6$—, $R^2$=$R^3$=—$C_{11}H_{23}$).

Ethylene glycol distearate and trimethylene glycol distearate are more preferred among these diester compounds.

The effects of the present disclosure are readily obtained when the wax contains the diester compound with formula (2) as its major component. Specifically, the content of the diester compound in the wax is preferably from 50 mass % to 100 mass % and is more preferably from 95 mass % to 100 mass %.

In addition, the wax content per 100 mass parts of the binder resin is preferably from 5 mass parts to 30 mass parts and is more preferably from 10 mass parts to 30 mass parts. The effects of the present disclosure are obtained in a stable manner by using a content of at least 5 mass parts. On the other hand, coexistence with the storage stability is more readily obtained by using a content of not more than 30 mass parts.

The wax may contain additional wax besides the diester compound with general formula (2).

This additional wax can be specifically exemplified by the following:

aliphatic hydrocarbons such as low molecular weight polyethylenes, low molecular weight polypropylenes, microcrystalline waxes, paraffin waxes, and Fischer-Tropsch waxes, and multifunctional ester waxes such as the following: pentaerythritol ester compounds such as pentaerythritol tetrapalmitate, pentaerythritol tetrabehenate, and pentaerythritol tetrastearate; glycerol ester compounds such as hexaglycerol tetrabehenate tetrapalmitate, hexaglycerol octabehenate, pentaglycerol heptabehenate, tetraglycerol hexabehenate, triglycerol pentabehenate, diglycerol tetrabehenate, and glycerol tribehenate; and dipentaerythritol ester compounds such as dipentaerythritol hexamyristate and dipentaerythritol hexapalmitate.

The acid value of the diester compound is preferably from 0.01 mg KOH/g to 2.0 mg KOH/g, more preferably from 0.03 mg KOH/g to 1.0 mg KOH/g, and still more preferably from 0.05 mg KOH/g to 0.5 mg KOH/g. The acid value of this diester compound is the value measured using the test method for the acid value of chemical products established by the Japanese Industrial Standards and is based on JIS K 0070. The details of the measurement method are described below.

When the acid value of the diester compound is not more than 2.0 mg KOH/g, this suppresses the occurrence of residual unreacted fatty acid-derived carboxylic acid groups in the diester compound, and because of this the stable formation of liquid droplets of the polymerizable monomer composition in the liquid droplet formation step is facilitated, good particle diameter characteristics are provided for the toner particle, and the occurrence of reductions in image quality due to, e.g., fogging, is suppressed. In addition, the generation of volatile substances during fixing is inhibited, suppressing this as a cause of odor. When the acid value of the diester compound is at least 0.01 mg KOH/g, this facilitates a suitable occurrence of the diester compound also at the toner particle surface, and is thus preferred from the standpoint of the low-temperature fixability.

The hydroxyl value of the diester compound is preferably from 0.1 mg KOH/g to 15 mg KOH/g, more preferably from 0.3 mg KOH/g to 10 mg KOH/g, still more preferably from 0.5 mg KOH/g to 5.0 mg KOH/g, and particularly preferably from 1.0 mg KOH/g to 4.0 mg KOH/g. The hydroxyl value of this diester compound is the value measured using the test method for the hydroxyl value of chemical products established by the Japanese Industrial Standards and is based on JIS K 0070.

When the hydroxyl value of the diester compound is not more than 15 mg KOH/g, this suppresses the occurrence of residual unreacted starting material-derived hydroxyl groups in the diester compound, and because of this the stable formation of liquid droplets of the polymerizable monomer composition in the liquid droplet formation step is facilitated, good particle diameter characteristics are provided for the toner particle, and the occurrence of reductions in image quality due to, e.g., fogging, is suppressed. When the hydroxyl value of the diester compound is at least 0.1 mg KOH/g, this facilitates a suitable occurrence of the diester compound also at the toner particle surface, and is thus preferred from the standpoint of the low-temperature fixability.

The method for producing the diester compound is not particularly limited, and can be exemplified by synthesis methods based on an oxidation reaction; synthesis from carboxylic acid or a derivative thereof; reactions that introduce an ester group, as represented by the Michael addition reaction; methods that utilize a dehydration condensation reaction from a carboxylic acid compound and an alcohol compound; reactions from an acid halide and an alcohol compound; transesterification reactions; and so forth.

A suitable catalyst may also be used to produce the diester compound. Preferred for this catalyst are the acidic and alkaline catalysts commonly used in esterification reactions, for example, zinc acetate and titanium compounds. The esterification reaction may be followed by purification of the target compound by, e.g., recrystallization, distillation, and so forth.

A specific example of the production of the diester compound is given in the following, but the method for producing the diester compound is not limited to the following production example.

The alcohol monomer and carboxylic acid monomer constituting the starting materials are first added to a reactor. The molar ratio between the alcohol monomer and carboxylic acid monomer is adjusted as appropriate in conformity with the chemical structure of the target diester compound. That is, the alcohol monomer and carboxylic acid monomer are mixed so as to provide an alcohol monomer:carboxylic acid monomer molar ratio=1:2. Either of the alcohol monomer and carboxylic acid monomer may be added in some excess over the indicated ratio, based on a consideration of, e.g., the reactivity in the dehydration condensation reaction.

The alcohol monomer+carboxylic acid monomer mixture is then heated as appropriate to carry out the dehydration condensation reaction. A basic aqueous solution and a suitable organic solvent are added to the crude esterification product provided by the dehydration condensation reaction and the unreacted alcohol monomer and carboxylic acid monomer are deprotonated and separated into the aqueous phase. The target diester compound is then obtained by carrying out a water wash, distillative removal of the solvent, and filtration as appropriate.

The melting point of the diester compound is preferably from 65° C. to 85° C. and more preferably from 70° C. to 79° C.

The use of this range facilitates establishing coexistence between the low-temperature fixability and storage stability of the toner.

The toner particle comprises a binder resin (B). The binder resin (B) is not particularly limited and resins known for use with toners can be used.

Specific examples are vinyl resins, styrene resins, styrenic copolymer resins, polyester resins, polyol resins, polyvinyl chloride resins, phenolic resins, natural resin-modified phenolic resins, natural resin-modified maleic acid resins, acrylic resins, methacrylic resins, polyvinyl acetate, silicone resins, polyurethane resins, polyamide resins, furan resins, epoxy resins, xylene resins, polyvinyl butyral, terpene resins, coumarone-indene resins, and petroleum resins. Resins preferred for use among the preceding are styrenic copolymer resins, polyester resins, and hybrid resins provided by mixing a polyester resin and a vinyl resin or partially reacting the two.

From the standpoint of compatibility with the diester compound, vinyl resins are preferred among the preceding and styrenic copolymer resins are more preferred.

The content of the binder resin (B) in the toner is preferably from 70 mass % to 90 mass %.

The compatibility between the wax and the binder resin (B) can be controlled using the Hansen solubility parameter (also referred to herebelow as the SP value).

The solubility parameter is a numerical value used as an index of affinity or solubility; it shows to what extent a particular substance dissolves in a particular different substance. When two solubility parameters are near each other, the solubility or affinity is higher; when the solubility parameters are separated, the solubility or affinity is lower.

Using SP1 ($(J/cm^3)^{1/2}$) for the SP value of the binder resin (B) and using SP2 ($(T/cm^3)^{1/2}$) for the SP value of the wax, SP1-SP2 for the toner is preferably from 1.8 to 2.0. From 1.9 to 2.0 is more preferred. A lower value for SP1-SP2 indicates a higher affinity between the wax and the binder resin (B), while a higher value indicates a lower affinity between the wax and the binder resin (B). Having SP1-SP2 be in the indicated range facilitates control of the state of occurrence of the wax in the toner and facilitates striking a balance among toner scattering, the fixing performance, and the storability.

SP1 is preferably from 18.2 to 18.7 and more preferably from 18.4 to 18.5. Having SP1 be in the indicated range facilitates striking a balance between the durability and fixing performance.

SP2 is preferably from 16.0 to 16.8 and is more preferably from 16.2 to 16.6. Having SP2 be in the indicated range enables a suitable degree of suppression of exposure of the wax at the surface.

SP1 can be controlled by changing the ratio for the monomers that constitute the binder resin (B). SP2 can be controlled by, for example, changing the monomer species serving as the starting materials for the diester compound in the wax, the type and content of wax other than the diester compound, and so forth.

When a plurality of compounds are incorporated as the wax, the SP2 value is the value provided by taking the weighted average of the SP2 values of the individual compounds.

For example, the SP2 value is as follows for the case in which a wax having an SP2 value of $SP2_A$ is incorporated at A mol % with reference to the number of moles of all the compounds incorporated as the wax and a wax having an SP2 value of $SP2_B$ is incorporated at (100−A) mol % with reference to the number of moles of all the compounds incorporated as the wax:

$$SP2=(SP2_A \times A+SP2_B \times (100-A))/100.$$

The calculation is carried out in the same manner when at least three compounds are incorporated as the wax.

The toner comprises a toner particle, and this toner particle should comprise the aforementioned diester compound but is not otherwise particularly limited; its method of production is also not particularly limited.

This toner particle may be produced by a pulverization method or may be produced by a method that produces the toner particle in an aqueous medium, e.g., a dispersion polymerization method, association aggregation method, dissolution suspension method, suspension polymerization method, or emulsion aggregation method.

However, from the standpoint of controlling the state of occurrence of the diester compound, methods that produce the toner particle in an aqueous medium are preferred, and toner particle production by the suspension polymerization method is particularly preferred from the standpoint of controlling toner shape.

The suspension polymerization method is described in the following.

In the suspension polymerization method, a polymerizable monomer composition is obtained by dissolving or dispersing polymerizable monomer and wax (and optionally a colorant, polymerization initiator, crosslinking agent, charge control agent, and other additives) to uniformity. A polymerization reaction is then run while at the same time dispersing this polymerizable monomer composition, using a suitable stirrer, in a continuous phase (for example, an aqueous phase) that contains a dispersing agent, to obtain a toner particle having the desired particle diameter. The toner particle provided by this suspension polymerization method (also referred to hereafter as the "polymerized toner particle") has an individual toner particle shape uniformly brought to an approximately spherical shape, and due to this the charge quantity distribution is also made relatively uniform and an improvement in the image quality can then be expected.

Examples of the polymerizable monomer constituting the polymerizable monomer composition in the production of the polymerized toner particle are given in the following.

A monovinyl monomer is preferably used for the polymerizable monomer. The monovinyl monomer can be exemplified by styrene; styrene derivatives, e.g., vinyltoluene and α-methylstyrene; acrylic acid and methacrylic acid; acrylate esters, e.g., methyl acrylate, ethyl acrylate, propyl acrylate, butyl acrylate, 2-ethylhexyl acrylate, and dimethylaminoethyl acrylate; methacrylate esters such as methyl methacrylate, ethyl methacrylate, propyl methacrylate, butyl methacrylate, 2-ethylhexyl methacrylate, and dimethylaminoethyl methacrylate; nitrile compounds, e.g., acrylonitrile and methacrylonitrile; amide compounds, e.g., acrylamide and methacrylamide; and olefins, e.g., ethylene, propylene and butene.

A single one of these monovinyl monomers may be used by itself, or a combination of at least two may be used.

Among the preceding, at least one selection from the group consisting of styrene, styrene derivatives, acrylate esters, and methacrylate esters is preferably included in the monovinyl monomer. At least one selection from the group consisting of styrene and butyl acrylate is more preferably included. The use of the aforementioned polymerizable monomer facilitates control of the compatibility with the diester compound and facilitates obtaining the effects of the present disclosure.

The polymerizable monomer preferably contains the aforementioned monovinyl monomer as its main component. Specifically, the monovinyl monomer content in the polymerizable monomer is preferably from 50 mass % to 100 mass %.

The polymerization initiator used in toner particle production by a polymerization method can be exemplified by persulfate salts, e.g., potassium persulfate and ammonium persulfate; azo compounds, e.g., 4,4'-azobis(4-cyanovaleric acid), 2,2'-azobis(2-methyl-N-(2-hydroxyethyl)propionamide), 2,2'-azobis(2-amidinopropane) dihydrochloride, 2,2'-azobis(2,4-dimethylvaleronitrile), and 2,2'-azobisisobutyronitrile; and organoperoxides, e.g., di-t-butyl peroxide, benzoyl peroxide, t-butyl peroxy-2-ethylhexanoate, t-butyl peroxydiethylacetate, t-hexyl peroxy-2-ethylbutanoate, diisopropyl peroxydicarbonate, di-t-butyl peroxyisophthalate, and t-butyl peroxyisobutyrate. A single one of these may be used by itself, or a combination of at least two may be used. Among the preceding, the use of organoperoxide is preferred because this makes it possible to minimize residual polymerizable monomer and to also provide an excellent print durability.

Among the organoperoxides, peroxyesters are preferred because they provide a good initiation efficiency and because they also make it possible to minimize residual polymerizable monomer; nonaromatic peroxyesters, i.e., peroxyesters lacking an aromatic ring, are more preferred.

The polymerization initiator may be added prior to liquid droplet formation after dispersion of the polymerizable monomer composition in an aqueous medium, supra, or may be added to the polymerizable monomer composition prior to dispersion in the aqueous medium.

The amount of addition of the polymerization initiator used for polymerization of the polymerizable monomer composition, per 100 mass parts of the polymerizable monomer, is preferably from 0.1 mass parts to 20 mass parts, more preferably from 0.3 mass parts to 15 mass parts, and particularly preferably from 1 mass parts to 10 mass parts.

A crosslinking agent may be added to toner particle production by a polymerization method. The preferred amount of crosslinking agent addition is from 0.001 mass parts to 15 mass parts per 100 mass parts of the polymerizable monomer.

Compounds having at least two polymerizable double bonds are mainly used as the crosslinking agent. Specific examples are aromatic divinyl compounds, e.g., divinylbenzene and divinylnaphthalene and their derivatives; ester compounds in which at least two carboxylic acids having a carbon-carbon double bond, are ester-bonded to an alcohol having at least two hydroxyl groups, e.g., ethylene glycol dimethacrylate and diethylene glycol dimethacrylate; other divinyl compounds, e.g., N,N-divinylaniline and divinyl ether; and compounds having at least three vinyl groups.

A single one of these crosslinking agents may be used by itself, or a combination of at least two may be used.

The toner particle may comprise a colorant. A colorant, e.g., black, cyan, yellow, or magenta, may be used in the preparation of colored toner.

The black colorant can be, for example, carbon black, titanium black, or a magnetic powder, e.g., zinc iron oxide or nickel iron oxide.

The cyan colorant can be, for example, a copper phthalocyanine compound, a derivative thereof, an anthraquinone compound, and so forth-pecific examples are C.I. Pigment Blue 2, 3, 6, 15, 15:1, 15:2, 15:3, 15:4, 16, 17:1, and 60.

The yellow colorant can be, for example, a compound such as a condensed polycyclic pigment or an azo pigment such as a monoazo pigment or disazo pigment. Specific examples are C.I. Pigment Yellow 3, 12, 13, 14, 15, 17, 62, 65, 73, 74, 83, 93, 97, 120, 138, 155, 180, 181, 185, 186, and 213.

The magenta colorant can be, for example, a compound such as a condensed polycyclic pigment or an azo pigment such as a monoazo pigment or disazo pigment. Specific examples are C.I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255, and 269 and C.I. Pigment Violet 19.

For each of these colorants, a single one may be used by itself or at least two may be used in combination. The amount of the colorant is preferably from 1 mass parts to 10 mass parts per 100 mass parts of the polymerizable monomer.

In order to improve the charging performance of the toner, a positive-charging or negative-charging charge control agent may be used as an additional additive.

The charge control agent should be a charge control agent as commonly used for toners, but is not otherwise particularly limited. Among charge control agents, positive-charging charge control resins and negative-charging charge control resins are preferred because they exhibit a high compatibility with the polymerizable monomer and can provide the toner particle with a stable charging performance (charge stability). The use of a positive-charging charge control resin is more preferred with regard to obtaining a positive-charging toner.

Positive-charging charge control agents can be exemplified by nigrosine dyes, quaternary ammonium salts, triaminotriphenylmethane compounds, and imidazole compounds, and charge control resins preferred for use can be exemplified by polyamine resins, copolymers containing a quaternary ammonium group, and copolymers containing a quaternary ammonium salt group.

Negative-charging charge control agents can be exemplified by azo dyes that contain a metal such as Cr, Co, Al, or Fe, metal salicylate compounds, and metal alkylsalicylate compounds, and charge control resins preferred for use can be exemplified by sulfonic acid group-containing copolymers, sulfonate salt group-containing copolymers, carboxylic acid group-containing copolymers, and carboxylate salt group-containing copolymers.

The charge control agent is used in proportions, per 100 mass parts of the polymerizable monomer, of preferably from 0.01 mass parts to 10 mass parts and more preferably from 0.03 mass parts to 8 mass parts. The occurrence of fogging is suppressed when the amount of charge control agent addition is at least 0.01 mass parts. On the other hand, the occurrence of print staining is suppressed when the amount of charge control agent addition is not more than 10 mass parts.

A molecular weight modifier is preferably used, as an additional additive, during the polymerization of the polymerizable monomer that will form the binder resin by polymerization.

The molecular weight modifier should be a molecular weight modifier as generally used for toners, but is not otherwise particularly limited. Examples are mercaptans such as t-dodecyl mercaptan, n-dodecyl mercaptan, n-octyl mercaptan, and 2,2,4,6,6-pentamethylheptane-4-thiol, and thiuram disulfides such as tetramethylthiuram disulfide, tetraethylthiuram disulfide, tetrabutylthiuram disulfide, N,N'-dimethyl-N,N'-diphenylthiuram disulfide, and N,N'-dioctadecyl-N,N'-diisopropylthiuram disulfide. A single one of these molecular weight modifiers may be used by itself, or at least two may be used in combination.

The molecular weight modifier is used in proportions, per 100 mass parts of the polymerizable monomer, of preferably from 0.01 mass parts to 10 mass parts and more preferably from 0.1 mass parts to 5 mass parts.

In toner particle production by a polymerization method, generally the starting materials for the toner particle, supra, are suitably combined; a polymerizable monomer composition is prepared by dissolution or dispersion to uniformity using a disperser, e.g., a homogenizer, ball mill, or ultrasound disperser; and this polymerizable monomer composition is suspended in an aqueous medium that contains a dispersing agent. During this process, a sharp particle diameter may be established for the resulting toner particle when the size desired for the toner particle is immediately established using a high-speed disperser such as a high-speed stirrer or ultrasound disperser.

With regard to the timing of polymerization initiator addition, the polymerization initiator may be added at the same time as the addition of the other additives to the polymerizable monomer or may be admixed immediately before suspension in the aqueous medium. The polymerization initiator dissolved in the polymerizable monomer or solvent may also be added immediately after granulation and before the start of the polymerization reaction.

Granulation may be followed by stirring, using an ordinary stirrer, to a degree sufficient to maintain the particulate state and prevent particle flotation/sedimentation.

A known surfactant, organic dispersing agent, or inorganic dispersing agent can be used as the dispersing agent during toner particle production. Among these, the use is preferred of inorganic dispersing agents for the following reasons: because they provide dispersion stability through steric hindrance, they resist disruptions in stability even when the reaction temperature is changed; and they are unlikely to exercise negative effects on the toner because they are also easily washed out. Such inorganic dispersing agents can be exemplified by sulfate salts, e.g., barium sulfate and calcium sulfate; carbonate salts, e.g., barium carbonate, calcium carbonate, and magnesium carbonate; phosphate salts, e.g., calcium phosphate; metal oxides, e.g., aluminum oxide and titanium oxide; and metal hydroxides, e.g., aluminum hydroxide, magnesium hydroxide, and ferric hydroxide.

These inorganic dispersing agents are desirably used at from 0.2 mass parts to 20 mass parts per 100 mass parts of the polymerizable monomer. A single such dispersing agent may be used by itself or a plurality may be used in combination. In addition, from 0.001 mass parts to 0.1 mass parts of a surfactant may be co-used.

The polymerization temperature in the step of polymerizing the polymerizable monomer is preferably at least 50° C. and is more preferably from 60° C. to 95° C. The reaction time for the polymerization is preferably from 1 hour to 20 hours and is more preferably from 2 hours to 15 hours.

The wax-containing polymer particle yielded by this polymerization reaction may be used as such as a polymerized toner particle; however, a polymer particle is preferred that is a so-called core-shell type (or, also known as a "capsule type"), in which the polymer particle functions as a core layer on the outside of which is constructed a shell layer different from the core layer. By coating a core layer composed of a material having a low softening point with a material have a higher softening point than the core layer, a core-shell type polymer particle can strike a balance between lowering the fixation temperature and preventing aggregation during storage.

There are no particular limitations on the method for producing this core-shell type polymer particle using the aforementioned polymer particle, and production can be carried out using heretofore known methods. Among these, the in situ polymerization method and the phase separation method are preferred in terms of production efficiency.

Production of a core-shell type polymer particle by in situ polymerization is described in the following.

The core-shell type polymer particle can be obtained by adding, to an aqueous medium in which polymer particles are dispersed, polymerizable monomer for forming the shell layer (shell polymerizable monomer) and a polymerization initiator and carrying out polymerization.

The same polymerizable monomers that have been described above may be used as the shell polymerizable monomer. Among these, the use is preferred of monomer that yields polymer having a glass transition temperature (Tg) in excess of 80° C., e.g., styrene, acrylonitrile, methyl methacrylate, and so forth, and a single such monomer can be used or a combination of at least two can be used. Among these, the use of at least methyl methacrylate as the shell polymerizable monomer is preferred.

The polymerization initiator used for polymerization of the shell polymerizable monomer can be exemplified by water-soluble polymerization initiators, e.g., metal persulfate salts such as potassium persulfate and ammonium persulfate, and azo initiators such as 2,2'-azobis(2-methyl-N-(2-hydroxyethyl)propionamide), 2,2'-azobis(2-methyl-N-(1,1-bis(hydroxymethyl)-2-hydroxyethyl)propionamide), 2,2'-azobis[N-(2-carboxyethyl)-2-methylpropionamidine], and their hydrates. A single one of these may be used by itself, or a combination of at least two may be used. The amount of the polymerization initiator, per 100 mass parts of the shell polymerizable monomer, is preferably from 0.1 mass parts to 30 mass parts and more preferably from 1 mass parts to 20 mass parts.

When the phase separation method is used, a polymer, which is provided by the preliminary polymerization of shell-forming material, is preferably added to polymerizable monomer for forming the core. When a pre-polymerized polymer is used, it is more preferably a reactive polymer having an unsaturated bond.

The polymerization temperature for the shell layer is preferably at least 50° C. and more preferably from 60° C. to 95° C. The reaction time for the polymerization is preferably from 1 hour to 20 hours and is more preferably from 2 hours to 15 hours.

The toner particle can also be obtained by subjecting the obtained polymer particle as necessary to filtration, washing, and drying using known methods. In addition, it may also optionally be introduced into a classification step and the coarse powder and fines present in the toner particle may be cut.

The obtained toner particle may also be used as such as toner. In addition, the toner may also be obtained by optionally mixing an external additive with the toner particle to attach same to the toner particle surface.

The stirring device used to carry out the mixing process should be a stirring device that can bring about the attachment of the external additive to the toner particle surface, but is not otherwise particularly limited. For example, the external addition process can be carried out using a stirrer capable of mixing and stirring, e.g., an FM Mixer (product name, Nippon Coke & Engineering Co., Ltd.), Supermixer (product name, Kawada Seisakusho Co. Ltd.), Q Mixer (product name, Nippon Coke & Engineering Co., Ltd.), Mechanofusion System (product name, Hosokawa Micron Corporation), and Mechanomill (product name, Okada Seiko Co., Ltd.).

The external additive can be exemplified by inorganic fine particles of, e.g., silica, titanium oxide, aluminum oxide, zinc oxide, tin oxide, calcium carbonate, calcium phosphate, cerium oxide, and so forth, and by organic fine particles of, e.g., polymethyl methacrylate resin, silicone resin, melamine resin, and so forth. Inorganic fine particles are preferred therebetween, and silica and titanium oxide are preferred among inorganic fine particles with silica being more preferred.

A single one of these external additives may be used by itself, or at least two may be used in combination.

The content of the external additive, per 100 mass parts of the toner particle, is preferably from 0.05 mass parts to 6 mass parts and more preferably from 0.2 mass parts to 5 mass parts.

The toner may comprise additional additives within a range in which the effects according to the present disclosure are not affected.

The additional additives can be exemplified by lubricants, e.g., fluororesins, zinc stearate, and polyvinylidene fluoride; abrasives, e.g., cerium oxide, silicon carbide, and strontium titanate; and anticaking agents. The additional additive may also be used after its surface has been subjected to a hydrophobing treatment.

The glass transition temperature (Tg) of the toner is preferably from 40.0° C. to 70.0° C. and is more preferably from 45.0° C. to 65.0° C.

A high degree of coexistence between the storage stability and low-temperature fixability can be brought about when the glass transition temperature of the toner is in the indicated range. This glass transition temperature can be controlled through, for example, the composition of the binder resin (B), the wax type, and the molecular weight of the binder resin (B).

The volume-average particle diameter (D4) of the toner is preferably from 3.0 μm to 8.0 μm and more preferably from 5.0 μm to 7.7 μm.

By having the volume-average particle diameter (D4) of the toner reside in the indicated range, a fully satisfactory dot reproducibility can be brought about while providing the toner with good handling characteristics.

In addition, the ratio (D4/D1) for the toner of the volume-average particle diameter (D4) to the number-average particle diameter (D1) is preferably not more than 1.25 and is more preferably less than 1.25.

The D4 and D4/D1 of the toner can be controlled through, for example, the amount of the dispersing agent and the type of stirring device and its rotation rate.

The melting temperature (Tm) of the toner as determined by the ½ method using a Flowtester is preferably from 100° C. to 150° C. and is more preferably from 120° C. to 140° C. Coexistence between the low-temperature fixability and the hot offset resistance is readily brought about when the Tm of the toner is in the indicated range.

This Tm can be controlled through, for example, the monomer species for and the molecular weight of the binder resin (B).

The number-average molecular weight (Mn) of the binder resin (B) is preferably from 5,000 to 20,000 and is more preferably from 7,000 to 15,000. The low-temperature fixability is improved when the binder resin (B) has an Mn of not more than 20,000. The heat-resistant storability is improved when this Mn is at least 5,000.

The weight-average molecular weight (Mw) of the binder resin (B) is preferably from 100,000 to 300,000 and is more preferably from 150,000 to 280,000. The low-temperature fixability is improved when the binder resin (B) has an Mw of not more than 300,000. The heat-resistant storability is improved when this Mw is at least 100,000.

The molecular weight distribution (Mw/Mn) of the binder resin (B) is preferably from 10 to 40 and more preferably from 15 to 35. The low-temperature fixability and storability are improved when this Mw/Mn is not more than 40. The hot offset resistance is enhanced when this Mw/Mn is at least 10.

The Mn and Mw of the binder resin (B) can be controlled, for example, by altering the various conditions in the production of the binder resin (B).

The photosensitive member is described next.

Electrophotographic Photosensitive Member

In an example of a method for producing the photosensitive member, coating solutions for the individual layers, see below, are prepared; the coating solutions are coated on a support in the desired layer sequence; and drying is carried out. The method used to apply the coating solution in this process can be exemplified by immersion coating, spray coating, inkjet coating, roll coating, die coating, blade coating, curtain coating, wire bar coating, ring coating, and so forth. Immersion coating is preferred among these from the standpoints of efficiency and productivity.

The individual layers are described in the following.

Support

The photosensitive member can comprise a support. This support is preferably a conductive support that exhibits electrical conductivity. The shape of the support can be exemplified by cylindrical, belt-shaped, sheet-shaped, and so forth. A cylindrical support is preferred thereamong. An electrochemical treatment, e.g., anodic oxidation, and/or a blast treatment, milling treatment, and so forth, may be executed on the surface of the support.

The material of the support is preferably, for example, a metal, resin, or glass.

The metals can be exemplified by aluminum, iron, nickel, copper, gold, and stainless steel and their alloys. An aluminum support that uses aluminum is preferred thereamong.

Conductivity may be imparted to the resin or glass by the admixture of or coating with a conductive material.

Conductive Layer

A conductive layer may be disposed on the support. The disposition of a conductive layer can cover over scratches and unevenness in the surface of the support and can control light reflection at the support surface.

The conductive layer preferably contains conductive particles and a resin.

The material of the conductive particles can be exemplified by metal oxides, metals, and carbon black.

The metal oxides can be exemplified by zinc oxide, aluminum oxide, indium oxide, silicon oxide, zirconium oxide, tin oxide, titanium oxide, magnesium oxide, antimony oxide, and bismuth oxide.

The metals can be exemplified by aluminum, nickel, iron, Nichrome, copper, zinc, and silver.

Among the preceding, the use of metal oxide for the material of the conductive particle is preferred, and the use of titanium oxide, tin oxide, or zinc oxide in particular is more preferred.

When a metal oxide is used as the material of the conductive particle, the surface of the metal oxide particle may be subjected to treatment with, for example, a silane coupling agent, and/or the metal oxide may be doped with an element such as phosphorus or aluminum or with an oxide thereof.

The conductive particle may have a layered configuration that comprises a core particle and a coating layer coated on this particle. The material of the core particle can be exemplified by titanium oxide, barium sulfate, and zinc oxide. The material of the coating layer can be exemplified by metal oxides such as tin oxide.

When a metal oxide particle is used as the conductive particle, its volume-average particle diameter is preferably from 1 nm to 500 nm and more preferably from 3 nm to 400 nm.

The resin can be exemplified by polyester resins, polycarbonate resins, polyvinyl acetal resins, acrylic resins, silicone resins, epoxy resins, melamine resins, polyurethane resins, phenolic resins, and alkyd resins.

The conductive layer may also contain, for example, a masking agent, e.g., silicone oil, resin particles, or titanium oxide.

The average film thickness of the conductive layer is preferably from 1 μm to 50 μm and particularly preferably from 3 μm to 40 μm.

The conductive layer can be formed by preparing a conductive layer coating solution containing solvent and the individual materials that have been described above, forming a coating film from this coating solution, and drying. The solvent used for the coating solution can be exemplified by alcohol solvents, sulfoxide solvents, ketone solvents, ether solvents, ester solvents, and aromatic hydrocarbon solvents. The dispersing method for dispersing the conductive particles in the conductive layer coating solution can be exemplified by methods that use a paint shaker, sand mill, ball mill, or liquid collision-type high-speed disperser.

Undercoat Layer

An undercoat layer may be disposed on the support or conductive layer. Through the disposition of an undercoat layer, the adhesiveness between layers can be increased and the ability to stop charge injection can be provided.

The undercoat layer preferably contains a resin. The undercoat layer may be formed as a cured film provided by the cure of a composition that contains a polymerizable functional group-bearing monomer.

The resin can be exemplified by polyester resins, polycarbonate resins, polyvinyl acetal resins, acrylic resins, epoxy resins, melamine resins, polyurethane resins, phenolic resins, polyvinylphenol resins, alkyd resins, polyvinyl alcohol resins, polyethylene oxide resins, polypropylene oxide resins, polyamide resins, polyamic acid resins, polyimide resins, polyamideimide resins, and cellulose resins.

The polymerizable functional group present in the polymerizable functional group-bearing monomer can be exemplified by the isocyanate group, blocked isocyanate group, methylol group, alkylated methylol group, epoxy group, metal alkoxide group, hydroxyl group, amino group, carboxyl group, thiol group, carboxylic acid anhydride group, and carbon-carbon double bond group.

With the goal of enhancing the electrical characteristics, the undercoat layer may additionally contain, for example, an electron transport substance, metal oxide, metal, electroconductive polymer, and so forth. Among these, the incorporation of an electron transport substance and metal oxide is preferred.

The electron transport substance can be exemplified by quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The undercoat layer may be formed as a cured film through the copolymerization of the aforementioned polymerizable functional group-bearing monomer using a polymerizable functional group-bearing electron transport substance as the electron transport substance.

The metal oxide can be exemplified by indium tin oxide, tin oxide, indium oxide, titanium oxide, zinc oxide, aluminum oxide, and silicon dioxide.

The metal can be exemplified by gold, silver, and aluminum.

The undercoat layer may also contain an additive.

The average film thickness of the undercoat layer is preferably from 0.1 μm to 50 μm, more preferably from 0.2 μm to 40 μm, and still more preferably from 0.3 μm to 30 μm.

The undercoat layer can be formed by preparing an undercoat layer coating solution containing solvent and the individual materials that have been described above, forming a coating film from this coating solution, and drying and/or curing. The solvent used for the coating solution can be exemplified by alcohol solvents, ketone solvents, ether solvents, ester solvents, and aromatic hydrocarbon solvents.

Photosensitive Layer

The photosensitive member can generally comprise a photosensitive layer. This photosensitive layer is preferably formed on a support, and the conductive layer and/or undercoat layer as described above may be present between the support and the photosensitive layer. Photosensitive layers are mainly classified into (1) monolayer-type photosensitive layers and (2) laminated-type photosensitive layers.

(1) A monolayer-type photosensitive layer can comprise, for example, a photosensitive layer that contains a charge generation substance, charge transport substance, and electron transport substance in combination.

(2) A laminated-type photosensitive layer can comprise, for example, a charge generation layer that contains a charge generation substance and a charge transport layer that contains a charge transport substance.

(1) Monolayer-Type Photosensitive Layer

The photosensitive layer can be implemented as a monolayer-type photosensitive layer. This monolayer-type photosensitive layer can be formed, for example, by preparing a photosensitive layer coating solution containing a charge generation substance, charge transport substance, electron transport substance, resin, and solvent; forming a coating film from this coating solution; and drying. When this monolayer-type photosensitive layer is the surface layer of the photosensitive member, this resin comprises the binder resin (A).

When the monolayer-type photosensitive layer is the surface layer of the photosensitive member, the monolayer-type photosensitive layer may contain, within a range that does not impair the effects of the present disclosure, a resin other than the binder resin (A). This other resin can be exemplified by polycarbonate resins, styrene resins, and acrylic resins.

The charge generation substance can be exemplified by azo pigments, perylene pigments, polycyclic quinone pigments, indigo pigments, and phthalocyanine pigments. Among these, azo pigments and phthalocyanine pigments are preferred. Among phthalocyanine pigments, metal-free phthalocyanines, oxytitanium phthalocyanine pigments, chlorogallium phthalocyanine pigments, and hydroxygallium phthalocyanine pigments are preferred.

The charge transport substance can be exemplified by polycyclic aromatic compounds, heterocyclic compounds, hydrazone compounds, styryl compounds, enamine compounds, benzidine compounds, and triarylamine compounds, and by resins having a group derived from these substances. A single one of these charge transport substances may be used by itself, or at least two may be used in combination. Triarylamine compounds and benzidine compounds are preferred among the preceding.

The electron transport substance can be exemplified by quinone compounds, diimide compounds, hydrazone compounds, malononitrile compounds, thiopyran compounds, trinitrothioxanthone compounds, 3,4,5,7-tetranitro-9-fluorenone compounds, dinitroanthracene compounds, dinitroacridine compounds, tetracyanoethylene, 2,4,8-trinitrothioxanthone, dinitrobenzene, dinitroacridine, succinic anhydride, maleic anhydride, and dibromomaleic anhydride.

The quinone compounds can be exemplified by diphenoquinone compounds, azoquinone compounds, anthraquinone compounds, naphthoquinone compounds, nitroanthraquinone compounds, and dinitroanthraquinone compounds.

A single one of these electron transport substances may be used by itself, or two or more may be used in combination.

Compounds represented by formulas (4) to (12) below are preferred among these electron transport substances.

(4)

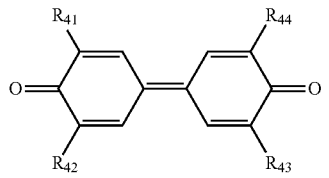

(5)

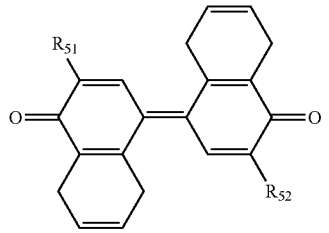

(6)

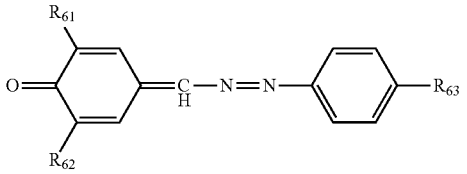

(7)

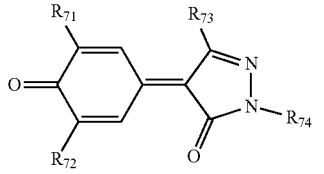

(8)

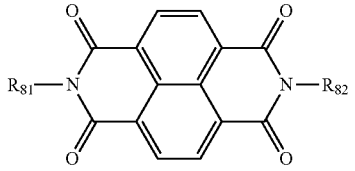

(9)

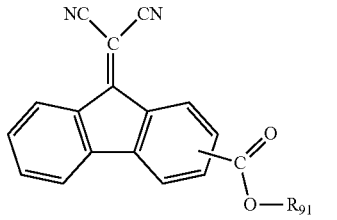

-continued (10)

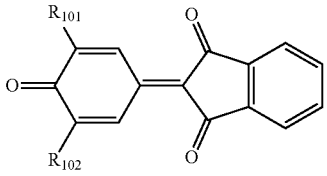

(11)

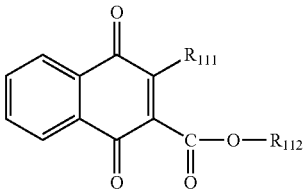

(12)

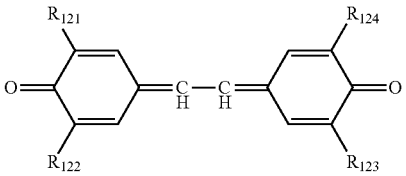

In formulas (4) to (12):

$R_{41}$ to $R_{44}$, $R_{51}$, $R_{52}$, $R_{61}$, $R_{62}$, $R_{71}$ to $R_{73}$, $R_{101}$, $R_{102}$, and $R_{121}$ to $R_{124}$ each independently represent a hydrogen atom or alkyl group having from 1 to 6 (preferably from 1 to 4) carbons;

$R_{63}$ represents a hydrogen atom, halogen group, or alkyl group having from 1 to 6 (preferably from 1 to 4) carbons;

$R_{74}$, $R_{81}$, and $R_{82}$ each independently represent an alkyl group having from 1 to 6 (preferably from 1 to 4) carbons, a halogen group, or a phenyl group possibly bearing an alkyl group having from 1 to 6 (preferably from 1 to 4) carbons;

$R_{91}$ represents a hydrogen atom or an alkyl group having from 1 to 6 (preferably from 1 to 4) carbons and possibly bearing a halogen atom; and $R_{111}$ and $R_{112}$ represent an alkyl group having from 1 to 6 (preferably from 1 to 4) carbons and possibly bearing a substituent, or a possibly substituted phenyl group.

The content ratio (mass ratio) between the charge generation substance and the total resin component in the photosensitive layer is preferably from 1:1000 to 50:100 and is more preferably from 5:1000 to 30:100.

The content ratio (mass ratio) between the charge transport substance and the total resin component in the photosensitive layer is preferably from 1:10 to 20:10 and is more preferably from 1:10 to 10:10.

The content ratio (mass ratio) between the electron transport substance and the total resin component in the photosensitive layer is preferably from 5:100 to 10:10 and is more preferably from 1:10 to 8:10.

The photosensitive layer may contain additives such as an oxidation inhibitor, ultraviolet absorber, plasticizer, leveling agent, slip agent, wear resistance improver, and so forth. Specific examples are hindered phenol compounds, hindered amine compounds, sulfur compounds, phosphorus compounds, benzophenone compounds, siloxane-modified resins, silicone oils, fluororesin particles, polystyrene resin particles, polyethylene resin particles, silica particles, alumina particles, boron nitride particles and so forth.

Among these, silica particles may be added in order to improve the durability of the photosensitive layer.

A surface treatment with a surface treatment agent may have been executed on these silica particles. This surface treatment agent can be exemplified by hexamethyldisilazane, N-methylhexamethyldisilazane, hexamethyl-N-propyldisilazane, dimethyldichlorosilane, and polydimethylsiloxane. The surface treatment agent is particularly preferably hexamethyldisilazane.

The silica particle content is preferably from 0.5 mass parts to 15 mass parts per 100 mass parts of the binder resin (A).

The silica particle content is preferably from 0.5 mass parts to 15 mass parts and more preferably from 1 mass parts to 10 mass parts, per 100 mass parts of the total resin component in the photosensitive layer.

The volume-average particle diameter of the silica particles is preferably from 7 nm to 1,000 nm and more preferably from 10 nm to 300 nm. The silica particles can be identified and their volume-average particle diameter can be determined by observation of a cross section of the photosensitive layer using, for example, a scanning electron microscope (SEM).

The average film thickness of the photosensitive layer is preferably from 5 μm to 100 μm and more preferably from 10 μm to 50 μm.

The photosensitive layer can be formed by preparing a photosensitive layer coating solution containing the individual materials described above and a solvent, forming a coating film therefrom, and drying. The solvent used in the coating solution can be exemplified by alcohol solvents, ketone solvents, ether solvents, ester solvents, and aromatic hydrocarbon solvents. Ether solvents and aromatic hydrocarbon solvents are preferred among these solvents.

(2) Laminated-Type Photosensitive Layer

The photosensitive layer may be a laminated-type photosensitive layer. This laminated-type photosensitive layer can comprise, for example, a charge generation layer and a charge transport layer.

The charge generation layer may comprise a charge generation substance and a resin.

The charge transport layer may comprise a charge transport substance and a resin. When this laminated-type photosensitive layer is the surface layer of the photosensitive member, the charge transport layer then contains the binder resin (A).

The same materials as provided above as examples of the materials in "(1) The Monolayer-Type Photosensitive Layer" can be used as the charge generation substance, charge transport substance, and resin.

The content of the charge generation substance in the charge generation layer, per the total mass of the charge generation layer, is preferably from 40 mass % to 85 mass % and more preferably from 60 mass % to 80 mass %.

The average film thickness of the charge generation layer is preferably from 0.1 μm to 1 μm and more preferably from 0.15 μm to 0.4 μm.

The content of the charge transport substance in the charge transport layer, per the total mass of the charge transport layer, is preferably from 25 mass % to 70 mass % and more preferably from 30 mass % to 55 mass %.

The content ratio (mass ratio) between the charge transport substance and resin is preferably from 4:10 to 20:10 and is more preferably from 5:10 to 12:10.

The same additives as provided above as examples in "(1) The Monolayer-Type Photosensitive Layer" may be incorporated as additives.

The average film thickness of the charge transport layer is preferably from 5 μm to 50 μm, more preferably from 8 μm to 40 μm, and particularly preferably from 10 μm to 30 μm.

Process Cartridge and Image Forming Apparatus

A process cartridge of the present disclosure comprises;

an electrophotographic photosensitive member, and a developing device that has a toner and supplies the toner onto the electrophotographic photosensitive member, the electrophotographic photosensitive member comprises a surface layer comprising the aforementioned binder resin (A), the toner is the aforementioned toner, and the process cartridge is disposed detachably in a main body of an image forming apparatus.

The process cartridge may optionally comprise one or more selections from the group consisting of a charging apparatus, image forming device, transfer apparatus, and cleaning apparatus.

In addition, an image forming apparatus of the present disclosure comprises:

an electrophotographic photosensitive member; and a developing device that has a toner and supplies the toner onto the electrophotographic photosensitive member, wherein the electrophotographic photosensitive member comprises a surface layer containing the aforementioned binder resin (A), the toner comprises the aforementioned toner particle.

The image forming apparatus may optionally comprise one or more selections from the group consisting of a charging apparatus, image forming device, transfer apparatus, cleaning apparatus, and exposure apparatus.

The FIGURE provides an example of a schematic configuration of an image forming apparatus that has a process cartridge that is provided with an electrophotographic photosensitive member.

Here, 1 is a cylindrical electrophotographic photosensitive member, which rotates at a prescribed peripheral velocity centered on an axle 2 and in the direction of the arrow. The surface of the electrophotographic photosensitive member 1 is charged by a charging means 3 to a prescribed positive or negative potential. While the FIGURE depicts a roller charging system that uses a roller charging member, a charging system such as a corona charging system, proximity charging system, injection charging system, and so forth may be employed.

The surface of the charged electrophotographic photosensitive member 1 is irradiated with exposure light 4 from an exposure means (not shown) to form an electrostatic latent image that corresponds to the target image information. The electrostatic latent image formed on the surface of the electrophotographic photosensitive member 1 is developed by a toner, which is held in a developing means 5, and a toner image is formed on the surface of the electrophotographic photosensitive member 1. The toner image formed on the surface of the electrophotographic photosensitive member 1 is transferred by a transfer means 6 to a transfer material 7. The transfer material 7, bearing the transferred toner image, is transported to a fixing means 8, subjected to a fixing process for the toner image, and printed out to the outside of the image forming apparatus.

The image forming apparatus may have a cleaning means 9 in order to remove adhered material, e.g., toner, that remains on the surface of the electrophotographic photosensitive member 1 after transfer. In addition, a so-called cleanerless system may be used, in which this adhered material is removed using, for example, the developing means, without the separate disposition of a cleaning means. The image forming apparatus may have a charge erasure mechanism that subjects the surface of the electrophotographic photosensitive member 1 to a charge erasure treatment using a pre-exposure light 10 from a pre-exposure means (not shown). A guide means 12, e.g., a rail, may be disposed to support process cartridge 11 detachability in the image forming apparatus.

The electrophotographic photosensitive member can be used in, for example, a laser beam printer, LED printer, copier, facsimile machine, or a hybrid of the preceding.

Cartridge Set

The cartridge set of the present disclosure has the following features.

A cartridge set comprises a first cartridge and a second cartridge that are disposed detachably in a main body of an image forming apparatus, wherein the first cartridge has an electrophotographic photosensitive member, the second cartridge has a toner container that accommodates a toner for forming a toner image on a surface of the electrophotographic photosensitive member by developing an electrostatic latent image formed on the surface of the electrophotographic photosensitive member, the electrophotographic photosensitive member comprises a surface layer containing the aforementioned binder resin (A), the toner comprises the aforementioned toner particle.

The first cartridge may have a charging apparatus for charging the surface of the electrophotographic photosensitive member. The first cartridge may also have a first frame for supporting the electrophotographic photosensitive member (and optionally the charging apparatus).

The first cartridge or the second cartridge may be provided with a developing device for forming a toner image on the surface of the electrophotographic photosensitive member. The developing device may be fixed in the body of the image forming apparatus.

The methods used to measure the properties involved with the present disclosure are described in the following.

Method for Measuring Melting Temperature (Tm) of Toner by ½ Method

The melting temperature (Tm) of the toner by the ½ method is measured using a "Flowtester CFT-500D Flow Property Evaluation Instrument" (Shimadzu Corporation), which is a constant-load extrusion-type capillary rheometer.

The CFT-500D is an instrument that, while applying a constant load by a piston from the top of a measurement sample filled in a cylinder, can heat and melt the measurement sample and extrude it from a capillary orifice at the bottom of the cylinder, and that can graph out a flow curve from the piston stroke (mm) and the temperature (° C.) during this process.

The melting temperature by the ½ method is determined as follows.

First, ½ of the difference between the piston stroke at the completion of outflow (outflow completion point, designated Smax) and the piston stroke at the start of outflow (minimum point, designated Smin) is determined (this value is designated as X, where X=(Smax−Smin)/2). The temperature in the flow curve when the piston stroke reaches the sum of X and Smin is the melting temperature by the ½ method.

The measurement sample used is prepared by subjecting 1.2 g of the toner to compression molding for 60 seconds at 10 MPa in a 25° C. environment using a tablet compression molder (Standard Manual Newton Press NT-100H, NPa System Co., Ltd.) to provide a cylindrical shape with a diameter of 8 mm.

The specific measurement procedure follows the procedure in the manual provided with the instrument.

The measurement conditions with the CFT-500D are as follows.

Test mode: ramp-up method
Start temperature: 40° C.
Saturated temperature: 200° C.
Measurement interval: 1.0° C.
Ramp rate: 3.0° C./min
Piston cross section area: 1.000 $cm^2$
Test load (piston load): 10.0 kgf
Preheating time: 5 minutes
Diameter of die orifice: 0.5 mm
Die length: 1.0 mm
Shear stress: $2.451\times10^5$ Pa Method for Measuring Glass Transition Temperature of Toner The glass transition temperature of the toner is measured in accordance with ASTM D 3418-97.

Specifically, 10 mg of the toner provided by drying is exactly weighed and is introduced into an aluminum pan. An empty aluminum pan is used as the reference. Using a differential scanning calorimeter (product name: DSC6220, SII NanoTechnology Inc.), the glass transition temperature of the exactly weighed toner is measured in accordance with ASTM D 3418-97 at a ramp rate condition of 10° C./min in the measurement temperature range from 0° C. to 150° C.

Method for Measuring Molecular Weight of Toners and Resins

The number-average molecular weight (Mn), weight-average molecular weight (Mw), and molecular weight distribution (Mw/Mn) of the toners and resins are measured as follows using gel permeation chromatography (GPC) and tetrahydrofuran (THF).

(a) Preparation of Measurement Sample

The sample is provided by dissolving 10 mg of sample in 5 mL of tetrahydrofuran, standing for 16 hours at 25° C., and then passage across a 0.45 μm membrane filter (Pretreatment Cartridge H-25-2, Tosoh Corporation).

(b) Measurement Conditions measurement instrument: LC-GPC 150C from Waters Corporation
Column temperature: 35° C.
Solvent: tetrahydrofuran
Flow rate: 1.0 mL/min
Sample concentration: 0.2 mass %
Sample injection amount: 100 μL (c) Column GPC TSKgel MultiporeHXL-M (30 cm×2) from Tosoh Corporation is used. The measurement is performed at conditions at which the first-order correlation equation for Log (Mw)-elution time between weight-average molecular weight Mw=from 1,000 to 300,000 becomes at least 0.98.

Method for Measuring Melting Point of Waxes

From 6 mg to 8 mg of the wax is measured into the sample holder, and the DSC curve is obtained by carrying out measurement using a differential scanning calorimeter (product name: RDC-220, Seiko Instruments Inc.) and a ramp-up condition of 100° C./min from −200° C. to 1,000° C. The peak temperature of the endothermic peak in the DSC curve is taken to be the melting point.

Method for Measuring Acid Value of Waxes

The acid value of the waxes is measured based on JIS K 0070, which is a standard procedure for the analysis of oils and fats established by the Japanese Industrial Standards Committee (JICS).

The determination is specifically carried out using the following method.

1) From 0.5 g to 2.0 g of the wax is exactly weighed. This mass is designated M (g).

2) The wax is introduced into a 50-mL beaker, 25 mL of a tetrahydrofuran/ethanol mixed solvent (2/1) is added, and dissolution is carried out.

3) Titration is performed using a 0.1 mol/L ethanolic KOH solution and a potentiometric titrator ("COM-2500" Automatic Titrator from Hiranuma Sangyo Co., Ltd.).

4) The amount of the KOH solution used at this time is designated S (mL). The blank is measured at the same time, and the amount of KOH used in this case is designated B (mL).

5) The acid value is calculated using formula below. Here, f refers to the factor for the KOH solution.

$$\text{acid value [mg KOH/g]}=(S-B)\times f\times 5.61/M$$

Volume-average Particle Diameter D4 and Particle Diameter Distribution D4/D1 of Toners The volume-average particle diameter D4, number-average particle diameter D1, and particle diameter distribution D4/D1 of the toners is measured using a particle diameter analyzer (product name: Multisizer, Beckman Coulter, Inc.). Measurement with the Multisizer is performed using the following conditions: aperture diameter: 100 μm, dispersion medium: ISOTON II (product name), 10% concentration, number of particles measured: 100,000.

Specifically, 0.2 g of the toner is taken to a beaker and an aqueous alkylbenzenesulfonic acid solution (product name: DRIWEL, Fujifilm Corporation) is added to this as a dispersing agent. 2 mL of the dispersion medium is additionally added to this to wet the toner, after which 10 mL of the dispersion medium is added, dispersion is carried out for 1 minute using an ultrasound disperser, and the measurement is then performed using the aforementioned particle size analyzer.

Method for Determining Structures of Binder Resin (A) and Diester Compound with Formula (2), and Method for Measuring Molar Ratio in Binder Resin (A) Between Structure with Formula (1) and Structure with Formula (3)

The structures of the binder resin (A) and the diester compound with formula (2) and the molar ratio in the binder resin (A) between the structure with formula (1) and the structure with formula (3) are determined using nuclear magnetic resonance spectroscopic analysis ('H-NMR) [400 MHz, $CDCl_3$, room temperature (25° C.)].

Measurement instrument: JNM-EX400 FT-NMR instrument (JEOL Ltd.)
Measurement frequency: 400 MHz
Pulse condition: 5.0 μs
Frequency range: 10,500 Hz
Number of scans: 64
SAolvent: a deuterated solvent that dissolves the toner is used as appropriate Method for Separating Binder Resin (B) and Wax from Toner The toner is dissolved in tetrahydrofuran (THF) and the solvent is distillatively removed under reduced pressure from the resulting soluble component to obtain the tetrahydrofuran (THF)-soluble component of the toner.

The obtained tetrahydrofuran (THF)-soluble component of the toner is dissolved in chloroform to prepare a sample solution having a concentration of 25 mg/mL. 3.5 mL of the resulting sample solution is introduced into the following instrument and fractionation is performed, using the conditions indicated below, into a wax-derived low molecular weight component having a molecular weight of less than 2,000 and a binder resin-derived high molecular weight component having a molecular weight of at least 2,000. The fractionation conditions are as follows.

Preparative GPC instrument: Model LC-980 preparative HPLC, Japan Analytical Industry Co., Ltd.

Preparative column: JAIGEL 3H, JAIGEL 5H (Japan Analytical Industry Co., Ltd.)

Eluent: chloroform

Flow rate: 3.5 mL/min

After fractionation, the solvent is distilled off under reduced pressure and drying is additionally carried out for 24 hours under reduced pressure in a 90° C. atmosphere.

Method for Separating Binder Resin (A) from Surface Layer of Photosensitive Member The surface layer of the photosensitive member is dissolved in tetrahydrofuran (THF) and the solvent is distillatively removed under reduced pressure from the resulting soluble component to obtain the tetrahydrofuran (THF)-soluble component of the surface layer of the photosensitive member.

The obtained tetrahydrofuran (THF)-soluble component of the surface layer of the photosensitive member is dissolved in chloroform to prepare a sample solution having a concentration of 25 mg/mL. 3.5 mL of the resulting sample solution is introduced into the following instrument and fractionation is performed using the conditions indicated below. The fractionation conditions are as follows.

preparative GPC instrument: Model LC-980 preparative HPLC, Japan Analytical Industry Co., Ltd.

preparative column: JAIGEL 3H, JAIGEL 5H (Japan Analytical Industry Co., Ltd.)

eluent: chloroform flow rate: 3.5 mL/min

After fractionation, the solvent is distilled off under reduced pressure and drying is additionally carried out for 24 hours under reduced pressure in a 90° C. atmosphere.

Method for Measuring SP Value

The solubility parameter is calculated using Hansen Solubility Parameters in Practice, 4th Edition, 4.1.03 (available from https://www.hansen-solubility.com/HSPiP/), which is software for calculating solubility parameters. The calculation method is based on Hansen's solubility parameter theory. In Hansen's solubility parameter theory, the molecular vaporization energy is classified into three terms, i.e., energy due to dispersion forces (the dispersion term, also: D term), energy due to dipole interactions (polar term, also: P term), and energy due to hydrogen bonds (hydrogen bond term, also: H term), and each of these is handled as a three-dimensional vector.

The three-dimensional vectors for the solubility parameter are calculated using the following procedure.

(1): Using the solubility parameter calculation software cited above, the Hansen solubility parameters (D term, P term, H term), molar volume, and molecular weight are calculated for each unit (also referred to below as a monomer unit) derived from each monomer that is a precursor for the vinyl resin or polyester.

Monomer used in the vinyl resin: calculated for the state in which some halogen X, which does not influence the results of the calculation, has added across the double bond that undergoes cleavage in the polymerization, as shown in the following equation (A).

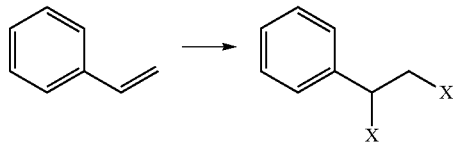

(A)

Monomer used for a compound having at least one ester bond: calculated for a state in which, of the functional groups in the monomer that undergo the condensation reaction, one is changed to [—C(═O)O—X] or [XC(═O)—O—] and the other functional group is substituted by X, as shown in the following equation (B).

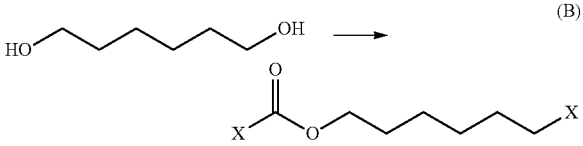

(B)

Monomer used for a compound having at least one carbonate bonds: calculated for a state in which, of the functional groups in the monomer that undergo the condensation reaction, one is changed to [—O—C(═O)O—X] and the other functional group is substituted by X, as shown in the following equation (C).

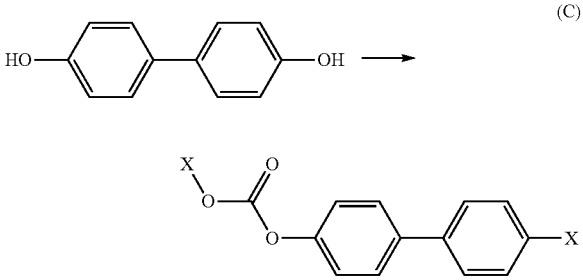

(C)

Monomer that condenses through a dehydration other than the preceding: when condensation proceeds via a reaction as shown in the following equation (D), the solubility parameter for the particular monomer is calculated for the state in which, as shown in formulas (E) and (F) below, one terminal of the monomer is constituted of the bonding group J and X and the other terminal is substituted by X.

$$\text{G-Ra-G+H—Rb-H} \rightarrow (\text{Ra-J-Rb})_n \quad \text{(D)}$$

$$\text{X-J-Ra-X} \quad \text{(E)}$$

$$\text{X-J-Rb-X} \quad \text{(F)}$$

In formulas (D) to (F), G and H are reactive functional groups, J is a bonding group, and Ra and Rb are organic groups.

(2): The molar volume ratio for the unit derived from each monomer is calculated from the molar ratio for each monomer unit in the polymer and the molar volume of each unit.

(3): The D term of the Hansen solubility parameter of the polymer is taken to be the sum of the values provided by multiplying the aforementioned molar volume ratio by the D term of the Hansen solubility parameter for each monomer unit. The P term and H term are similarly calculated.

(4): The square root is taken of the sum of the squares of the D term, P term, and H term calculated in (3) to give the SP value ($(J/cm^3)^{1/2}$) of the polymer.

The following method is used to calculate the solubility parameter when the binder resin (B), or the wax, is a mixture of at least two substances.

The solubility parameters (D term, P term, H term) are first calculated for each substance. The values provided by calculating the arithmetic average of the D term parameters for the individual substances, the arithmetic average of the P term parameters, and the arithmetic average of the H term parameters, are taken to be the solubility parameters (D term, P term, H term) of the mixture.

EXAMPLES

The present disclosure is described in additional detail in the following using examples and comparative examples; however, the present disclosure is in no way limited thereby. The number of parts in the examples and comparative examples is on a mass basis in all instances unless specifically indicated otherwise.

Wax 1 Production Example 300 parts of xylene, 15.5 parts of ethylene glycol, and 170 parts of stearic acid were added to a reactor fitted with a stirrer, thermometer, nitrogen introduction line, water removal line, and pressure reduction apparatus, and were heated to a temperature of 130° C. while stirring. 0.41 parts of tin di(2-ethylhexanoate) was then added as esterification catalyst, and the temperature was raised to a temperature of 200° C. and a condensation was run. After the reaction, the solvent was distilled off to obtain a wax 1. The properties of wax 1 are given in Table 1.

Waxes 2 to 10 Production Example

Waxes 2 to 10 were produced by the same method as in the Wax 1 Production Example, but changing the starting alcohol and starting acid as shown in Table 1. The properties of waxes 2 to 10 are given in Table 1.

styrene 75.0 parts
n-butyl acrylate 25.0 parts
carbon black 7 parts
(product name "#25B", Mitsubishi Chemical Corporation)
t-dodecyl mercaptan 1.0 part
divinylbenzene 0.6 parts
polymethacrylate ester macromonomer 0.25 parts
(product name "AA6", Toagosei Co., Ltd.)

These materials were wet pulverized using a media-type wet pulverizer, and the following materials were then mixed and dissolved thereinto to provide a polymerizable monomer composition.

wax 1 10.0 parts
positive charge control agent 1.0 part
(quaternary ammonium group-containing styrene/acrylic copolymer)

This polymerizable monomer composition was introduced at 25° C. into the colloidal magnesium hydroxide dispersion prepared as described above; the temperature was raised to 60° C. and stirring was carried out until the liquid droplets were stable; to this was added 5 parts of t-butyl peroxy-2-ethylhexanoate (product name "Perbutyl 0", NOF Corporation) as polymerization initiator; and liquid droplet formation from the polymerizable monomer composition was subsequently performed by high-shear stirring at a rotation rate of 15,000 rpm using an inline emulsifying disperser (product name "Ebara Milder", Ebara Corporation).

The thusly provided suspension in which liquid droplets of the polymerizable monomer composition were dispersed (a polymerizable monomer composition dispersion), was introduced into a reactor provided with a stirring blade, and the temperature was raised to 90° C. and a polymerization reaction was started. The following were added to the reactor when the polymerization conversion had reached approximately 100%: 1.5 parts of methyl methacrylate (shell polymerizable monomer) and 0.15 parts of 2,2'-azobis (2-methyl-(N-2-hydroxyethyl) propionamide) (shell polymerization initiator, product name "VA-086", water soluble, Wako Pure Chemical Industries, Ltd.) dissolved in 20 parts of deionized water. This was followed by continuing polymerization by holding for 3 hours at 90° C., then cooling with water to stop the reaction and yield an aqueous dispersion of colored resin particles. The dispersion stabilizer was dissolved by then adding hydrochloric acid to the suspension and thoroughly washing, and the toner particle 1 was obtained by filtration and drying. The formulation of the resulting toner particle 1 is given in Table 2.

TABLE 1

| | | alcohol monomer | | acid monomer | | acid value | melting point |
|---|---|---|---|---|---|---|---|
| | compound name | compound name | parts | compound name | parts | (mg KOH/g) | (° C.) |
| wax 1 | ethylene glycol distearate | ethylene glycol | 15.5 | stearic acid (C18) | 170 | 0.1 | 75 |
| wax 2 | trimethylene glycol distearate | trimetqene glycol | 18.5 | stearic acid (C18) | 170 | 0.1 | 76 |
| wax 3 | ethylene glycol dibehenate | ethylene glycol | 15.5 | behenic acid (C22) | 204 | 0.1 | 70 |
| wax 4 | ethylene glycol dicerotate | ethylene glycol | 15.5 | cerotic acid (C26) | 237 | 0.1 | 80 |
| wax 5 | ethylene glycol dilaurate | ethylene glycol | 15.5 | lauric acid (C12) | 120 | 0.1 | 72 |
| wax 6 | ethylene glycol dimyristate | ethylene glycol | 15.5 | myristic acid (C14) | 137 | 0.1 | 79 |
| wax 7 | 1,4-butanediol distearate | 1,4-butanediol | 22.5 | stearic acid (C18) | 170 | 0.1 | 76 |
| wax 8 | ethylene glycol dimontanate | ethylene glycol | 15.5 | montanic acid (C28) | 254 | 0.1 | 82 |
| wax 9 | ethylene glycol dicaprate | ethylene glycol | 15.5 | capric acid (C10) | 103 | 0.1 | 68 |
| wax 10 | behenyl behenate | behenyl alcohol | 100 | behenic acid (C22) | 101 | 1.1 | 75 |
| wax 11 | hydrocarbon wax (HNP51, Nippon Seiro Co., Ltd.) | | | | | 0.0 | 77 |

Toner Particle 1 Production Example

A colloidal magnesium hydroxide dispersion (3.0 parts of magnesium hydroxide) was prepared by the gradual addition, while stirring, of an aqueous solution of 4.1 parts of sodium hydroxide dissolved in 50 parts of deionized water, to an aqueous solution of 7.4 parts of magnesium chloride dissolved in 250 parts of deionized water.

TABLE 2

| toner No. | toner particle | St (parts) | BA (parts) | SP1 | wax No. | wax parts | wax SP2 | SP1-SP2 ((J/cm$^3$)$^{1/2}$) | D4 (μm) | D4/D1 | Tm (° C.) | Tg (° C.) | Mn | Mw | Mw/Mn |
|---|---|---|---|---|---|---|---|---|---|---|---|---|---|---|---|
| toner 1 | 1 | 75.0 | 25.0 | 18.5 | 1 | 10.0 | 16.5 | 2.0 | 7.6 | 1.15 | 125 | 52 | 8,800 | 245,400 | 27.9 |
| toner 2 | 2 | 75.0 | 25.0 | 18.5 | 2 | 10.0 | 16.5 | 2.0 | 7.7 | 1.16 | 125 | 52 | 8,700 | 235,200 | 27.0 |
| toner 3 | 3 | 75.0 | 25.0 | 18.5 | 3 | 10.0 | 16.6 | 1.9 | 7.5 | 1.17 | 128 | 55 | 8,600 | 254,000 | 29.5 |
| toner 4 | 4 | 75.0 | 25.0 | 18.5 | 4 | 10.0 | 16.7 | 1.8 | 7.8 | 1.15 | 125 | 53 | 8,500 | 248,200 | 29.2 |
| toner 5 | 5 | 75.0 | 25.0 | 18.5 | 5 | 10.0 | 16.4 | 2.1 | 7.4 | 1.16 | 123 | 50 | 8,700 | 272,200 | 31.3 |
| toner 6 | 6 | 90.0 | 10.0 | 18.6 | 6 | 10.0 | 16.4 | 2.2 | 7.6 | 1.17 | 130 | 57 | 8,700 | 2,546,000 | 292.6 |
| toner 7 | 7 | 70.0 | 30.0 | 18.4 | 4 | 10.0 | 16.7 | 1.7 | 7.8 | 1.15 | 118 | 47 | 8,600 | 264,200 | 30.7 |
| toner 8 | comparative 1 | 75.0 | 25.0 | 18.45 | 7 | 10.0 | 16.5 | 1.9 | 7.5 | 1.14 | 125 | 52 | 8,600 | 248,900 | 28.9 |
| toner 9 | comparative 2 | 75.0 | 25.0 | 18.45 | 8 | 10.0 | 16.8 | 1.7 | 7.7 | 1.16 | 125 | 53 | 8,500 | 257,800 | 30.3 |
| toner 10 | comparative 3 | 75.0 | 25.0 | 18.45 | 9 | 10.0 | 16.3 | 2.2 | 7.6 | 1.18 | 129 | 55 | 8,700 | 224,500 | 25.8 |
| toner 11 | comparative 4 | 75.0 | 25.0 | 18.45 | 10 | 10.0 | 16.3 | 2.2 | 7.4 | 1.19 | 131 | 58 | 8,800 | 254,100 | 28.9 |
| toner 12 | comparative 5 | 75.0 | 25.0 | 18.5 | 11 | 10.0 | 16.1 | 2.4 | 7.4 | 1.19 | 130 | 59 | 8,800 | 254,100 | 28.9 |

In the table, St refers to styrene and BA refers to n-butyl acrylate.

Toner Particles 2 to 7 and Comparative Toner Particles 1 to 5 Production Example Toner particles 2 to 7 and comparative toner particles 1 to 5 were obtained proceeding as in the Toner Particle 1 Production Example, but changing the amount of monomer constituting the binder resin B and the type and amount of the wax as shown in Table 2. The formulations for each of the resulting toner particles is shown in Table 2.

Toner 1 Production Example 0.3 parts of sol-gel silica fine particles having a number-average primary particle diameter of 115 nm was added to 100 parts of toner particle 1 and mixing was carried out using an FM mixer (Nippon Coke & Engineering Co., Ltd.). This was followed by the addition of 0.9 parts of hydrophobic silica fine particles and mixing again using the FM mixer (Nippon Coke & Engineering Co., Ltd.) to provide a toner 1. The hydrophobic silica fine particles used here were provided by the treatment of silica fine particles having a number-average primary particle diameter of 12 nm with hexamethyldisilazane followed by treatment with silicone oil; the hydrophobic silica fine particles had a post-treatment BET specific surface area value of 120 m$^2$/g.

The properties of the resulting toner 1 are given in Table 2.

Toners 2 to 12 Production Example

Toners 2 to 12 were obtained proceeding as in the Toner 1 Production Example, but changing the toner particle 1 to the toner particle indicated in Table 2. The properties of toners 2 to 12 are given in Table 2.

Binder Resin (A) 1 Production Example

The diol (10.6 parts) with formula (13) below, (13)

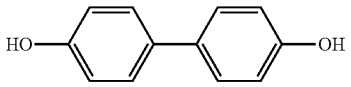

the diol (39.4 parts) with formula (14) below, (14)

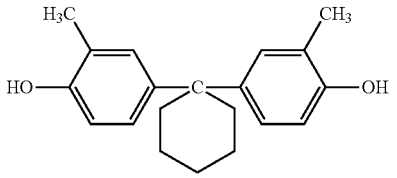

and 0.1 part of hydrosulfite were dissolved in 1100 parts of a 5 mass % aqueous sodium hydroxide solution. To this was added 500 parts of methylene chloride, and 60.0 parts of phosgene was then injected over 60 minutes while stirring and holding at 15° C.

After the completion of phosgene injection, 1.0 part of p-t-butylphenol was added as a molecular weight modifier and stirring was carried out and the reaction solution was emulsified. After emulsification, 0.3 parts of triethylamine was added and polymerization was carried out by stirring for 1 hour at 23° C.

After the completion of polymerization, the reaction solution was separated into an aqueous phase and an organic phase; the organic phase was neutralized with phosphoric acid; and washing with water was repeated until the conductivity of the wash liquid (aqueous phase) had reached not more than 10 μS/cm. The resulting polymer solution was added dropwise to warm water held at 45° C. and the solvent was removed by evaporation to yield a white particulate precipitate. The obtained precipitate was filtered off and dried for 24 hours at 110° C. to yield the binder resin (A) 1.

According to the results of investigations of the obtained binder resin (A) 1 by $^1$H-NMR, binder resin (A) 1 was a resin having 30 mol % of the structure represented by formula (1) and 70 mol % of the structure represented by formula (3). The properties of the obtained binder resin (A) 1 are given in Table 3.

Binder Resins (A) 2 to 16 Production Example

Binder resins (A) 2 to 16 were produced proceeding as in the Binder Resin (A) 1 Production Example, but changing the type of diol used so the $R_{11}$ in formula (1) and the $R_{21}$ to $R_{23}$ in formula (3) were as indicated in Table 1, and changing the amount and molar ratio of the structure with formula (1) and structure with formula (3) as indicated in Table 1. The properties of the obtained binder resins (A) 2 to 16 are given in Table 3.

TABLE 3

| binder resin | formula (1) | formula (3) | | | formula (1):formula (3) | |
|---|---|---|---|---|---|---|
| No. | $R^{11}$ | $R^{21}$ | $R^{22}$ | $R^{23}$ | molar ratio | Mw |
| (A)1 | H | methyl | * | | 30:70 | 110,000 |
| (A)2 | H | methyl | * | | 25:75 | 90,000 |
| (A)3 | H | methyl | * | | 50:50 | 60,000 |
| (A)4 | H | methyl | * | | 70:30 | 60,000 |
| (A)5 | H | methyl | * | | 80:20 | 60,000 |
| (A)6 | H | methyl | * | | 20:80 | 150,000 |
| (A)7 | H | H | * | | 30:70 | 110,000 |
| (A)8 | methyl | methyl | * | | 30:70 | 120,000 |
| (A)9 | methyl | H | * | | 30:70 | 110,000 |
| (A)10 | H | methyl | methyl | methyl | 30:70 | 90,000 |
| (A)11 | H | methyl | methyl | phenyl | 30:70 | 100,000 |
| (A)12 | H | methyl | H | methyl | 30:70 | 100,000 |
| (A)13 | H | methyl | methyl | ethyl | 30:70 | 80,000 |
| (A)14 | H | methyl | * | | 30:70 | 90,000 |
| (A)15 | — | H | methyl | ethyl | 0:100 | 110,000 |
| (A)16 | — | H | * | | 0:100 | 160,000 |

In Table 3, the * indicates that $R_{22}$, $R_{23}$, and the C between $R_{22}$ and $R_{23}$ are connected to form cyclohexylidene.

Photosensitive Member 1 Production Example

The following were introduced into a vessel:

3.0 parts of a metal-free phthalocyanine pigment as a charge generation substance, 60.0 parts of the compound with formula (15) below as a charge transport substance, (15)

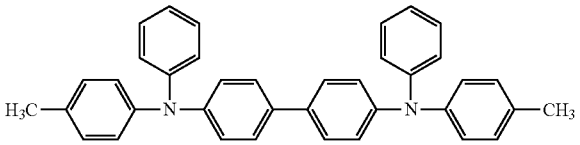

12.0 parts of the compound with formula (16) below and 28.0 parts of the compound with formula (17) below, as electron transport substances, (16)

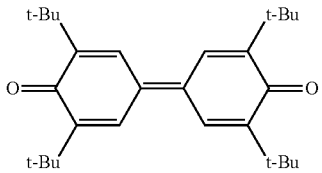

where, t-Bu represents the t-butyl group in formula (16).

(17)

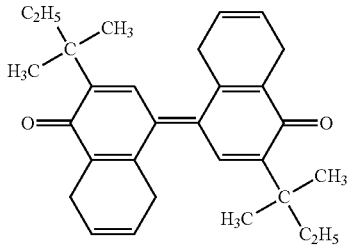

100 parts of the binder resin (A) 1 as binder resin, and 800 parts of tetrahydrofuran as solvent.

Using a rod-shaped ultrasound disperser, the materials and solvent were mixed for 2 minutes in the vessel to bring about a dispersion of the materials in the solvent. Then, using a ball mill, the materials and solvent were mixed for 50 hours to disperse the materials in the solvent and prepare a photosensitive layer coating solution.

This photosensitive layer coating solution was immersion coated on an aluminum support serving as a conductive substrate, and this was dried for 40 minutes at 100° C. to produce a photosensitive member 1 having a monolayer-type photosensitive layer having a film thickness of 25 μm. This monolayer-type photosensitive layer corresponds to the surface layer of the photosensitive member 1. The formulation for the obtained photosensitive member 1 is given in Table 4.

TABLE 4

| photosensitive member No. | binder resin No. | parts of silica | electron transport substance |
|---|---|---|---|
| photosensitive member 1 | (A)1 | 0 | compound with formula (16) compound with formula (17) |
| photosensitive member 2 | (A)2 | 0 | |
| photosensitive member 3 | (A)3 | 0 | |
| photosensitive member 4 | (A)4 | 0 | |
| photosensitive member 5 | (A)5 | 0 | |
| photosensitive member 6 | (A)6 | 0 | |
| photosensitive member 7 | (A)7 | 0 | |
| photosensitive member 8 | (A)8 | 0 | |
| photosensitive member 9 | (A)9 | 0 | |
| photosensitive member 10 | (A)10 | 0 | |
| photosensitive member 11 | (A)11 | 0 | |
| photosensitive member 12 | (A)12 | 0 | |
| photosensitive member 13 | (A)13 | 0 | |
| photosensitive member 14 | (A)14 | 1.0 | |
| photosensitive member 15 | (A)15 | 0 | |
| photosensitive member 16 | (A)16 | 1.0 | |

Photosensitive Members 2 to 13 and 15 Production Example

Photosensitive members 2 to 13 and 15 were obtained proceeding as in the Photosensitive Member 1 Production Example, but changing the binder resin (A) 1 as shown in Table 4. Photosensitive members 2 to 13 and 15 in each case are a photosensitive member having a monolayer-type photosensitive layer, and in each case the monolayer-type photosensitive layer corresponds to the surface layer of the particular photosensitive member. The formulations for the obtained photosensitive members 2 to 13 and 15 are given in Table 4.

Photosensitive Member 14 Production Example

The following were introduced into a vessel:

3.0 parts of the aforementioned metal-free phthalocyanine pigment as a charge generation substance, 60.0 parts of the compound with the preceding formula (15) as a charge transport substance, 12.0 parts of the compound with the preceding formula (16) and 28.0 parts of the compound with the preceding formula (17), as electron transport substances, 1.0 part of hexamethyldisilazane-surface-treated silica particles (Aerosil RX200, Nippon Aerosil Co., Ltd.) as an additive, 100 parts of the binder resin (A) 14 as binder resin, and 800 parts of tetrahydrofuran as solvent.

Using a rod-shaped ultrasound disperser, the materials and solvent were mixed for 2 minutes in the vessel to bring about a dispersion of the materials in the solvent. Then, using a ball mill, the materials and solvent were mixed for 50 hours to disperse the materials in the solvent and prepare a photosensitive layer coating solution.

This photosensitive layer coating solution was immersion coated on an aluminum support serving as a conductive substrate, and this was dried for 40 minutes at 100° C. to produce a photosensitive member 14 having a monolayer-type photosensitive layer having a film thickness of 25 μm. This monolayer-type photosensitive layer corresponds to the surface layer of the photosensitive member 14. The formulation for the obtained photosensitive member 14 is given in Table 4.

Photosensitive Member 16 Production Example

Photosensitive member 16 was obtained proceeding as in the Photosensitive Member 14 Production Example, but changing the binder resin (A) 14 to binder resin (A) 16. Photosensitive member 16 is a photosensitive member having a monolayer-type photosensitive layer, and this monolayer-type photosensitive layer corresponds to the surface layer of the photosensitive member 16. The formulation for the obtained photosensitive member 16 is given in Table 4.

Examples 1 to 20 and Comparative Examples 1 to 7

The following evaluations were performed on the toner/photosensitive member combinations indicated in Table 5.

Image Forming Apparatus

An HL-5470DW (monochrome laser printer from Brother Industries, Ltd.), which employs a monocomponent contact development system, was used.

A printer was used that had been modified to enable changes in the temperature of the fixing roller element during the fixing tests; 70 g of the toner was filled into the toner cartridge in this image forming apparatus; the print paper was loaded; and the following evaluations were performed.

The results of the evaluations are given in Table 5. The evaluation method and evaluation criteria are given below for each of the evaluations.

Evaluation of Toner Scattering

The evaluation of toner scattering was carried out in a normal-temperature, high-humidity environment (temperature of 25.0° C., 80% relative humidity). For the evaluation image, a horizontal line pattern image, in which a 4-dot horizontal line was printed every 176 dot spaces, was output on A4 OceRedLabel paper (areal weight=80 g/m$^2$) from Canon, Inc. Using 2 prints/1 job, the print mode was a mode in which the machine was set to temporarily stop between jobs, after which the next job was started. An image output test of a total of 1,000 prints was carried out, and the toner scattering was evaluated. Observation of the image on the 1,000th print using a 25× loupe was performed for the evaluation.

The scattering evaluation criteria are given below. A scattering evaluation of at least C is regarded as good.

A: There is no occurrence of toner scattering in observation with a 25× loupe.

B: Toner scattering occurs at several locations at the periphery of the image, in observation with a 25× loupe.

C: Toner scattering occurs at numerous locations at the periphery of the image, in observation with a 25× loupe.

D: The occurrence of toner scattering is also recognized visually, but not at a practically problematic level.

E: The occurrence of toner scattering is clearly recognized visually.

Evaluation of Low-temperature Fixability

The low-temperature fixability was evaluated in a normal-temperature, normal-humidity environment (temperature of 25.0° C., 60% relative humidity) using an HL-5470DW (monochrome laser printer from Brother Industries, Ltd.) and a cartridge from which the paper dust collection roller had been removed. This image forming apparatus had also been modified to enable the fixation temperature at its fixing unit to be freely settable.

Using this apparatus, a solid black image having a print percentage of 100% was output using FOX RIVER BOND paper (110 g/m$^2$), which is a rough paper, with the fixation temperature of the fixing unit being set at each 5° C. in the range from 180° C. to 230° C. During this sequence, the presence/absence of blank dot areas in the image in the solid image area was visually evaluated, and the low-temperature fixability was evaluated using the lowest temperature at which blank dot areas were produced.

A: Blank dots were produced at below 200° C.

B: Blank dots were produced at at least 200° C., but below 210° C.

C: Blank dots were produced at at least 210° C., but below 220° C.

D: Blank dots were produced at at least 220° C.

Evaluation of Storage Stability

Using an HL-5470DW (monochrome laser printer from Brother Industries, Ltd.) and a cartridge from which the paper dust collection roller had been removed, one print of a solid image was output in a normal-temperature, normal-humidity environment (temperature of 25.0° C., 60% relative humidity). This was followed by storage for 40 days of the entire developing device in a severe environment (temperature of 40.0° C., 95% relative humidity). After storage, one print of a solid image was output in a normal-temperature, normal-humidity environment (temperature of 25.0° C., 60% relative humidity), and a comparative evaluation of the image density pre-versus-post-storage was carried out. The density of the solid image was measured using a MacBeth reflection densitometer (MacBeth Corporation).

A: the density difference is less than 0.05

B: the density difference is at least 0.05, but less than 0.10

C: the density difference is at least 0.10, but less than 0.20

D: the density difference is equal to or greater than 0.20

Evaluation of Wear Resistance

The obtained photosensitive member was mounted in the cyan station of the evaluation machine in a low-temperature, low-humidity environment with a temperature of 20° C. and a humidity of 20% RH. After this, continuous image formation was carried out, on general-purpose A4 paper, of 100,000 prints of an image having an image print percentage of 5%. After the completion of image formation, the film thickness of the surface layer of the photosensitive member was measured, and the difference from the film thickness of the surface layer prior to image output was calculated to give the abraded amount of the surface layer. The abraded amount is rounded at the second decimal position.

A: the abraded amount is not more than 0.3 μm

B: the abraded amount is at least 0.4 μm but not more than 0.7 μm

C: the abraded amount is at least 0.8 μm

A score of at least B in the evaluation of the wear resistance is regarded as good.

TABLE 5

| | toner No. | photosensitive member No. | low-temperature fixability | toner scattering | wear resistance (amount abraded (μm)) | storability |
|---|---|---|---|---|---|---|
| Example 1 | toner 1 | 1 | A | A | A (0.2) | A (0.03) |
| Example 2 | toner 1 | 2 | A | B | A (0.3) | A (0.04) |
| Example 3 | toner 1 | 3 | A | A | A (0.2) | A (0.04) |
| Example 4 | toner 1 | 4 | A | A | A (0.1) | A (0.03) |
| Example 5 | toner 1 | 5 | A | A | A (0.1) | A (0.04) |
| Example 6 | toner 1 | 6 | A | C | B (0.5) | A (0.04) |
| Example 7 | toner 1 | 7 | A | A | A (0.2) | A (0.03) |
| Example 8 | toner 1 | 8 | A | B | A (0.2) | A (0.04) |
| Example 9 | toner 1 | 9 | A | B | A (0.3) | A (0.03) |
| Example 10 | toner 1 | 10 | A | A | A (0.3) | A (0.04) |
| Example 11 | toner 1 | 11 | A | A | B (0.6) | A (0.04) |
| Example 12 | toner 1 | 12 | A | A | B (0.6) | A (0.04) |
| Example 13 | toner 1 | 13 | A | A | A (0.1) | A (0.04) |
| Example 14 | toner 2 | 1 | A | B | A (0.2) | A (0.04) |
| Example 15 | toner 3 | 1 | B | A | A (0.2) | C (0.15) |
| Example 16 | toner 4 | 1 | A | A | A (0.2) | B (0.07) |
| Example 17 | toner 5 | 1 | A | A | A (0.2) | A (0.04) |
| Example 18 | toner 6 | 1 | C | A | A (0.2) | A (0.04) |
| Example 19 | toner 7 | 1 | A | A | A (0.1) | C (0.15) |
| Example 20 | toner 1 | 14 | A | A | A (0.1) | A (0.04) |
| Comparative Example 1 | toner 8 | 1 | A | D | A (0.2) | B (0.08) |
| Comparative Example 2 | toner 9 | 1 | A | A | A (0.2) | D (0.32) |
| Comparative Example 3 | toner 10 | 1 | D | A | A (0.2) | A (0.04) |
| Comparative Example 4 | toner 11 | 1 | D | E | A (0.2) | B (0.09) |
| Comparative Example 5 | toner 12 | 1 | D | E | A (0.2) | B (0.07) |
| Comparative Example 6 | toner 1 | 15 | A | E | C (1.1) | A (0.04) |
| Comparative Example 7 | toner 1 | 16 | A | E | C (0.8) | A (0.03) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-237011, filed Dec. 26, 2019 which is hereby incorporated by reference herein in its entirety.

What is claimed is:

1. An image forming apparatus comprising:

an electrophotographic photosensitive member; and a developing device that has a toner and supplies the toner onto the electrophotographic photosensitive member, wherein the electrophotographic photosensitive member comprises a surface layer comprising a binder resin (A), the binder resin (A) comprises a structure represented by formula (1) below:

(1)

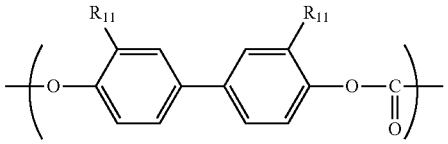

where, each $R_{11}$ independently represents a hydrogen atom or a methyl group, the toner comprises a toner particle, the toner particle comprises a binder resin (B) and a wax, and the wax comprises a diester compound represented by formula (2) below:

(2)

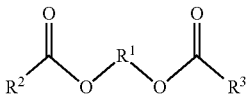

where, $R^1$ represents an alkylene group having 1 to 3 carbons and $R^2$ and $R^3$ each independently represent an alkyl group having 11 to 25 carbons.

2. The image forming apparatus according to claim 1, wherein $R^1$ is an ethylene group or a trimethylene group.

3. The image forming apparatus according to claim 1, wherein $R^1$ is an ethylene group.

4. The image forming apparatus according to claim 1, wherein, defining SP1 ($(J/cm^3)^{1/2}$) as an SP value of the binder resin (B) and SP2 ($(J/cm^3)^{1/2}$) as an SP value of the wax, SP1-SP2 is 1.8 to 2.0.

5. The image forming apparatus according to claim 1, wherein the binder resin (A) further comprises a structure represented by formula (3) below:

(3)

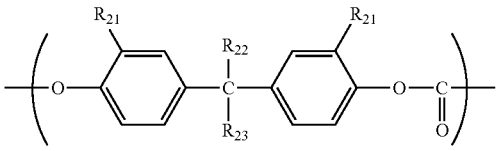

where, each $R_{21}$ independently represents a hydrogen atom or a methyl group, $R_{22}$ and $R_{23}$ each independently represent a hydrogen atom, a methyl group, an ethyl group, or a phenyl group, or $R_{22}$, $R_{23}$, and C between $R_{22}$ and $R_{23}$ in formula (3) are connected to form a cycloalkylidene group, and a molar ratio (structure represented by formula (1):structure represented by formula (3)), in the binder resin (A), between the structure represented by formula (1) and the structure represented by formula (3), is 5:95 to 95:5.

6. The image forming apparatus according to claim 5, wherein the structure represented by formula (3) is a structure represented by formula (3") below.

(3")

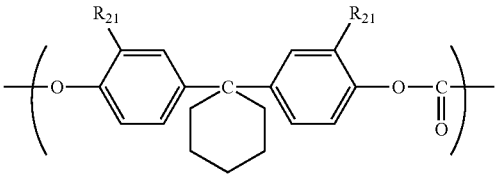

7. The image forming apparatus according to claim 1, wherein the surface layer is a photosensitive layer, and the photosensitive layer is a monolayer-type photosensitive layer having a photosensitive layer that comprises a charge generation substance, a charge transport substance, and an electron transport substance.

8. The image forming apparatus according to claim 1, wherein, defining SP1 ($(J/cm^3)^{1/2}$) as an SP value of the binder resin (B) and SP2 ($(J/cm^3)^{1/2}$) as an SP value of the wax, the SP1 is 18.2 to 18.7 and the SP2 is 16.0 to 16.8.

9. A process cartridge disposed detachably in a main body of an image forming apparatus, wherein the process cartridge comprises an electrophotographic photosensitive member, and a developing device that has a toner and supplies the toner onto the electrophotographic photosensitive member, the electrophotographic photosensitive member comprises a surface layer comprising a binder resin (A), the binder resin (A) comprises a structure represented by formula (1) below:

(1)

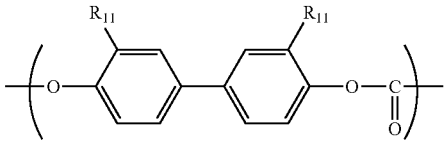

where, each $R_{11}$ independently represents a hydrogen atom or a methyl group, the toner comprises a toner particle, the toner particle comprises a binder resin (B) and a wax, and the wax comprises a diester compound represented by formula (2) below:

(2)

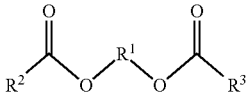

where, $R^1$ represents an alkylene group having 1 to 3 carbons and $R^2$ and $R^3$ each independently represent an alkyl group having 11 to 25 carbons.

10. A cartridge set comprising a first cartridge and a second cartridge that are disposed detachably in a main body of an image forming apparatus, wherein the first cartridge has an electrophotographic photosensitive member, the second cartridge has a toner container that accommodates a toner for forming a toner image on a surface of the electrophotographic photosensitive member by developing an electrostatic latent image formed on the surface of the electrophotographic photosensitive member, the electrophotographic photosensitive member comprises a surface layer comprising a binder resin (A), the binder resin (A) comprises a structure represented by formula (1) below:

(1)

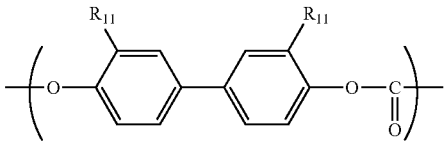

where, each $R_{11}$ independently represents a hydrogen atom or a methyl group, the toner comprises a toner particle, the toner particle comprises a binder resin (B) and a wax, and the wax comprises a diester compound represented by formula (2) below:

(2)

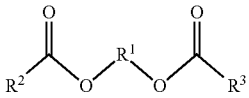

where, $R^1$ represents an alkylene group having 1 to 3 carbons and $R^2$ and $R^3$ each independently represent an alkyl group having 11 to 25 carbons.

* * * * *